US009725989B2

(12) United States Patent
Mayer et al.

(10) Patent No.: US 9,725,989 B2
(45) Date of Patent: Aug. 8, 2017

(54) SAND CONTROL SCREEN HAVING IMPROVED RELIABILITY

(71) Applicants: Christian S. Mayer, Pearland, TX (US); Charles S. Yeh, Spring, TX (US); David A. Howell, Houston, TX (US); Pavlin B. Entchev, Moscow (RU); Eric R. Grueschow, Houston, TX (US); Ted A. Long, Spring, TX (US); Tracy J. Moffett, Sugar Land, TX (US); Michael D. Barry, The Woodlands, TX (US); Michael T. Hecker, Tomball, TX (US); John S. Sladic, Katy, TX (US); Christopher A. Hall, Cypress, TX (US); Stephen McNamee, Houston, TX (US)

(72) Inventors: Christian S. Mayer, Pearland, TX (US); Charles S. Yeh, Spring, TX (US); David A. Howell, Houston, TX (US); Pavlin B. Entchev, Moscow (RU); Eric R. Grueschow, Houston, TX (US); Ted A. Long, Spring, TX (US); Tracy J. Moffett, Sugar Land, TX (US); Michael D. Barry, The Woodlands, TX (US); Michael T. Hecker, Tomball, TX (US); John S. Sladic, Katy, TX (US); Christopher A. Hall, Cypress, TX (US); Stephen McNamee, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 654 days.

(21) Appl. No.: 14/188,565

(22) Filed: Feb. 24, 2014

(65) Prior Publication Data

US 2014/0262260 A1 Sep. 18, 2014

Related U.S. Application Data

(60) Provisional application No. 61/798,519, filed on Mar. 15, 2013.

(51) Int. Cl.

| | |
|---|---|
| ***E21B 43/08*** | (2006.01) |
| ***E21B 43/12*** | (2006.01) |
| ***E21B 43/04*** | (2006.01) |

(52) U.S. Cl.

CPC ..... *E21B 43/08* (2013.01); *E21B 43/04* (2013.01); *E21B 43/082* (2013.01); *E21B 43/088* (2013.01); *E21B 43/12* (2013.01)

(58) Field of Classification Search

CPC ..... E21B 43/08; E21B 43/082; E21B 43/086; E21B 43/088; E21B 43/12

See application file for complete search history.

(56) References Cited

U.S. PATENT DOCUMENTS 1,473,644 A 11/1923 Rodrigo
1,594,788 A 1/1925 McLaughlin et al.
(Continued)

FOREIGN PATENT DOCUMENTS

WO WO 2013/055451 4/2013

OTHER PUBLICATIONS

Yeh, C.S. et al., "A Self-Mitigating Sand Control Screen", SPE 121844, SPE European Formation Damage Conference, May 27-29, 2009, 6 pages, Scheveningen, The Netherlands.
(Continued)

*Primary Examiner* — Giovanna C Wright
(74) *Attorney, Agent, or Firm* — ExxonMobil Upstream Research Company—Law Department

(57) ABSTRACT

A sand control device is used for restricting the flow of particles from a subsurface formation into a tubular body within a wellbore during production operations. The sand
(Continued)

control device is divided into compartments along its length that provide redundancy for particle filtration. Each compartment first comprises a base pipe. The base pipe defines an elongated tubular body having a permeable section and an impermeable section within each compartment. Each compartment also comprises a first filtering conduit and a second filtering conduit. The filtering conduits comprise filtering media and generally circumscribe the base pipe. The filtering conduits are arranged so that the first filtering conduit is adjacent to the non-permeable section of the base pipe, while the second filtering conduit is adjacent to the permeable section of the base pipe.

39 Claims, 17 Drawing Sheets

(56) References Cited

U.S. PATENT DOCUMENTS

| | | | |
|---|---|---|---|
| 1,620,412 | A | 3/1927 | Tweeddale |
| 2,681,111 | A | 6/1954 | Thompson |
| 3,173,488 | A | 3/1965 | Rensvold |
| 3,357,564 | A | 12/1967 | Medford, Jr. et al. |
| 3,556,219 | A | 1/1971 | Meldau |
| 4,064,938 | A | 12/1977 | Fast |
| 4,428,428 | A | 1/1984 | Smyrl et al. |
| 4,657,079 | A | 4/1987 | Nagaoka |
| 4,771,829 | A | 9/1988 | Sparlin |
| 4,818,403 | A | 4/1989 | Nagaoka |
| 4,945,991 | A | 8/1990 | Jones |
| 4,977,958 | A | 12/1990 | Miller |
| 5,004,049 | A | 4/1991 | Arterbury |
| 5,069,279 | A | 12/1991 | Nagaoka |
| 5,076,359 | A | 12/1991 | Yeh |
| 5,082,052 | A | 1/1992 | Jones et al. |
| 5,083,614 | A | 1/1992 | Branch |
| 5,113,935 | A | 5/1992 | Jones et al. |
| 5,115,864 | A | 5/1992 | Gaidry et al. |
| 5,161,613 | A | 11/1992 | Jones |
| 5,161,618 | A | 11/1992 | Jones et al. |
| 5,165,476 | A | 11/1992 | Jones |
| 5,209,296 | A | 5/1993 | Donlon |
| 5,222,556 | A | 6/1993 | Donlon |
| 5,246,158 | A | 9/1993 | Nagaoka et al. |
| 5,307,984 | A | 5/1994 | Nagaoka et al. |
| 5,311,942 | A | 5/1994 | Nagaoka |
| 5,318,119 | A | 6/1994 | Lowry et al. |
| 5,332,045 | A | 7/1994 | Ross et al. |
| 5,333,688 | A | 8/1994 | Jones et al. |
| 5,333,689 | A | 8/1994 | Jones et al. |
| 5,341,880 | A | 8/1994 | Thorstensen et al. |
| 5,355,949 | A | 10/1994 | Sparlin et al. |
| 5,390,966 | A | 2/1995 | Cox et al. |
| 5,392,850 | A | 2/1995 | Cornette et al. |
| 5,396,954 | A | 3/1995 | Brooks |
| 5,404,945 | A | 4/1995 | Head et al. |
| 5,415,202 | A | 5/1995 | Shiffler et al. |
| 5,417,284 | A | 5/1995 | Jones |
| 5,419,394 | A | 5/1995 | Jones |
| 5,435,391 | A | 7/1995 | Jones |
| 5,450,898 | A | 9/1995 | Sparlin et al. |
| 5,476,143 | A | 12/1995 | Sparlin et al. |
| 5,505,260 | A | 4/1996 | Andersen et al. |
| 5,515,915 | A | 5/1996 | Jones et al. |
| 5,560,427 | A | 10/1996 | Jones |
| 5,588,487 | A | 12/1996 | Bryant |
| 5,642,781 | A | 7/1997 | Richard |
| 5,664,628 | A | 9/1997 | Koehler et al. |
| 5,690,175 | A | 11/1997 | Jones |
| 5,787,980 | A | 8/1998 | Sparlin et al. |
| 5,803,179 | A | 9/1998 | Echols et al. |
| 5,842,516 | A | 12/1998 | Jones |
| 5,848,645 | A | 12/1998 | Jones |
| 5,868,200 | A | 2/1999 | Bryant et al. |
| 5,881,809 | A | 3/1999 | Gillespie et al. |
| 5,890,533 | A | 4/1999 | Jones |
| 5,896,928 | A | 4/1999 | Coon |
| 5,909,774 | A | 6/1999 | Griffith et al. |
| 5,934,376 | A | 8/1999 | Nguyen et al. |
| 6,003,600 | A | 12/1999 | Nguyen et al. |
| 6,112,817 | A | 9/2000 | Voll et al. |
| 6,125,932 | A | 10/2000 | Hamid et al. |
| 6,220,345 | B1 | 4/2001 | Jones et al. |
| 6,223,906 | B1 | 5/2001 | Williams |
| 6,227,303 | B1 | 5/2001 | Jones |
| 6,230,803 | B1 | 5/2001 | Morton et al. |
| 6,298,916 | B1 | 10/2001 | Tibbles et al. |
| 6,302,207 | B1 | 10/2001 | Nguyen et al. |
| 6,405,800 | B1 | 6/2002 | Walker et al. |
| 6,409,219 | B1 | 6/2002 | Broome et al. |
| 6,427,775 | B1 | 8/2002 | Dusterhoft et al. |
| 6,446,722 | B2 | 9/2002 | Nguyen et al. |
| 6,464,261 | B1 | 10/2002 | Dybevik et al. |
| 6,481,494 | B1 | 11/2002 | Dusterhoft et al. |
| 6,494,265 | B2 | 12/2002 | Wilson et al. |
| 6,513,599 | B1 | 2/2003 | Bixenman et al. |
| 6,516,881 | B2 | 2/2003 | Hailey, Jr. |
| 6,540,022 | B2 | 4/2003 | Dusterhoft et al. |
| 6,557,634 | B2 | 5/2003 | Hailey, Jr. et al. |
| 6,575,245 | B2 | 6/2003 | Hurst et al. |
| 6,575,251 | B2 | 6/2003 | Watson et al. |
| 6,581,689 | B2 | 6/2003 | Hailey, Jr. |
| 6,588,506 | B2 | 7/2003 | Jones |
| 6,601,646 | B2 | 8/2003 | Streich et al. |
| 6,619,397 | B2 | 9/2003 | Coon et al. |
| 6,622,794 | B2 | 9/2003 | Zisk, Jr. |
| 6,644,406 | B1 | 11/2003 | Jones |
| 6,666,274 | B2 | 12/2003 | Hughes |
| 6,675,245 | B1 | 1/2004 | Schmidt |
| 6,695,067 | B2 | 2/2004 | Johnson et al. |
| 6,698,518 | B2 | 3/2004 | Royer et al. |
| 6,715,544 | B2 | 4/2004 | Gillespie et al. |
| 6,749,023 | B2 | 6/2004 | Nguyen et al. |
| 6,749,024 | B2 | 6/2004 | Bixenman |
| 6,752,206 | B2 | 6/2004 | Watson et al. |
| 6,752,207 | B2 | 6/2004 | Donos |
| 6,755,245 | B2 | 6/2004 | Nguyen et al. |
| 6,789,623 | B2 | 9/2004 | Hill, Jr. et al. |
| 6,814,139 | B2 | 11/2004 | Hejl et al. |
| 6,817,410 | B2 | 11/2004 | Wetzel et al. |
| 6,830,104 | B2 | 12/2004 | Nguyen et al. |
| 6,848,510 | B2 | 2/2005 | Bixenman et al. |
| 6,857,475 | B2 | 2/2005 | Johnson |
| 6,886,634 | B2 | 5/2005 | Richards |
| 6,923,262 | B2 | 8/2005 | Broome et al. |
| 6,935,432 | B2 | 8/2005 | Nguyen |
| 6,983,796 | B2 | 1/2006 | Bayne et al. |
| 6,986,390 | B2 | 1/2006 | Doanne et al. |
| 6,997,263 | B2 | 2/2006 | Campbell et al. |
| 7,048,061 | B2 | 5/2006 | Bode et al. |
| 7,055,598 | B2 | 6/2006 | Ross et al. |
| 7,096,945 | B2 | 8/2006 | Richards et al. |
| 7,100,691 | B2 | 9/2006 | Nguyen et al. |
| 7,104,324 | B2 | 9/2006 | Wetzel et al. |
| 7,152,677 | B2 | 12/2006 | Parlar et al. |
| 7,207,383 | B2 | 4/2007 | Hurst et al. |
| 7,234,518 | B2 | 6/2007 | Smith |
| 7,243,724 | B2 | 7/2007 | McGregor et al. |
| 7,252,142 | B2 | 8/2007 | Brezinski et al. |
| 7,264,061 | B2 | 9/2007 | Dybevik et al. |
| 7,370,700 | B2 | 5/2008 | Hurst et al. |
| 7,377,320 | B2 | 5/2008 | Michel |
| 7,383,886 | B2 | 6/2008 | Dybevik et al. |
| 7,431,058 | B2 | 10/2008 | Holting |
| 7,464,752 | B2 | 12/2008 | Dale et al. |
| 7,475,725 | B2 | 1/2009 | Yeh et al. |
| 7,625,846 | B2 | 12/2009 | Cooke, Jr. |
| 7,661,476 | B2 | 2/2010 | Yeh et al. |
| 7,735,559 | B2 | 6/2010 | Malone |
| 7,814,973 | B2 | 10/2010 | Dusterhoft et al. |
| 7,845,407 | B2 | 12/2010 | Bunnell et al. |
| 7,870,898 | B2 | 1/2011 | Yeh et al. |

(56) References Cited

U.S. PATENT DOCUMENTS

| | | | | |
|---|---|---|---|---|
| 7,891,420 | B2 | 2/2011 | Dale et al. | |
| 7,984,760 | B2 | 7/2011 | Haeberle et al. | |
| 8,127,831 | B2 | 3/2012 | Haeberle et al. | |
| 8,245,778 | B2 | 8/2012 | Yeh et al. | |
| 8,522,867 | B2 | 9/2013 | Yeh et al. | |
| 2002/0157836 | A1* | 10/2002 | Royer | E21B 43/088 166/369 |
| 2003/0159825 | A1 | 8/2003 | Hurst et al. | |
| 2003/0173075 | A1 | 9/2003 | Morvant et al. | |
| 2003/0189010 | A1 | 10/2003 | Wilhelm | |
| 2004/0007829 | A1 | 1/2004 | Ross | |
| 2004/0134655 | A1* | 7/2004 | Richards | E21B 43/088 166/276 |
| 2004/0140089 | A1 | 7/2004 | Gunneroed | |
| 2005/0039917 | A1 | 2/2005 | Hailey, Jr. | |
| 2005/0045329 | A1 | 3/2005 | Wetzel et al. | |
| 2005/0067170 | A1 | 3/2005 | Richard | |
| 2005/0082060 | A1 | 4/2005 | Ward et al. | |
| 2005/0178562 | A1 | 8/2005 | Livingstone | |
| 2007/0114020 | A1 | 5/2007 | Brekke | |
| 2008/0006402 | A1 | 1/2008 | Russell | |
| 2008/0041577 | A1 | 2/2008 | Baaijens et al. | |
| 2008/0149323 | A1* | 6/2008 | O'Malley | E21B 34/06 166/53 |
| 2008/0217002 | A1 | 9/2008 | Simonds et al. | |
| 2009/0101355 | A1 | 4/2009 | Peterson et al. | |
| 2009/0120647 | A1* | 5/2009 | Turick | E21B 43/12 166/373 |
| 2009/0159279 | A1 | 6/2009 | Assal | |
| 2009/0159298 | A1 | 6/2009 | Assal | |
| 2009/0277650 | A1 | 11/2009 | Casciaro et al. | |
| 2010/0096120 | A1 | 4/2010 | Ayasse | |
| 2012/0061093 | A1 | 3/2012 | Garcia et al. | |
| 2013/0062066 | A1 | 3/2013 | Broussard et al. | |

OTHER PUBLICATIONS

Yeh, C.S. et al., "Advancing Self-Mitigating Sand Control Screen", IPTC 13614, International Petroleum Technology Conference, Dec. 7-9, 2009, 7 pages, Doha Qatar.

Yeh, C.S. et al., "Enhancing Sand Screen Reliability: An Innovative, Adaptive Approach", SPE 134492, SPE Annual Technical Conference, Sep. 19-22, 2010, 9 pages, Florence, Italy.

Yeh, C.S. et al., "Unlocking the Limits of Sand Screen Reliability with an Innovative and Self-Adapting Technology", IPTC 14623, 2011, 10 pages.

* cited by examiner

SAND CONTROL SCREEN HAVING IMPROVED RELIABILITY

CROSS REFERENCE TO RELATED APPLICATIONS

This application claims the benefit of U.S. Provisional No. 61/798,519, filed Mar. 15, 2013 and is incorporated by reference herein in its entirety.

This application is related to International Application No. PCT/US2012/052085, filed Aug. 23, 2012, which published as WO 2013/055451, and is incorporated by reference herein in its entirety.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of well completions and downhole operations. More specifically, the present invention relates to a sand control device, and methods for conducting wellbore operations using a downhole fluid filtering device.

Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of the formation behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place and perforated. In some instances, the final string of casing is a liner, that is, a string of casing that is not tied back to the surface.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

In some instances, a wellbore is completed as an open hole. In an open-hole completion, a production casing is not extended through the producing zones and perforated; rather, the producing zones are left uncased, or "open." A production string or "tubing" is then positioned inside the wellbore extending down to the last string of casing.

There are certain advantages to open-hole completions versus cased-hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation. Second, open-hole techniques are oftentimes less expensive than cased hole completions. In this respect, an open-hole completion eliminates the need for cementing, perforating, and post-perforation clean-up operations.

A common problem in open-hole completions is the immediate exposure of the wellbore to the surrounding formation. If the formation is unconsolidated or heavily sandy, the flow of production fluids into the wellbore will likely carry with it formation particles, e.g., sand and fines. Such particles are detrimental to production equipment. More specifically, formation particles can be erosive to downhole pumps as well as to pipes, valves, and fluid separation equipment at the surface.

To control the invasion of sand and other particles, sand control devices may be employed. Sand control devices are usually installed downhole across formations to retain solid materials larger than a certain diameter while allowing fluids to be produced. A sand control device typically includes an elongated tubular body, known as a base pipe, having numerous slotted openings or perforations. The base pipe is then typically wrapped with a filtration medium such as a wire wrap screen or a metal mesh screen.

To augment sand control devices, particularly in open-hole completions, it is common to install a gravel pack. Gravel packing a well involves placing gravel or other particulate matter around the sand control device after the sand control device is hung or otherwise placed in the wellbore. To install a gravel pack, a particulate material is delivered downhole by means of a carrier fluid. The carrier fluid with the gravel together form a gravel slurry. The slurry dries in place, leaving a circumferential packing of gravel. The gravel not only aids in particle filtration but also helps maintain wellbore integrity.

It is also known in the oil and gas industry to deploy stand-alone screens. These screens are placed into the wellbore at the end of a production string. Generally, it is more cost effective to install a stand-alone sand screen than a gravel pack. However, stand-alone screens tend to be less robust than a gravel pack. Particularly, the single sand control barrier in a stand-alone screen exposed to an open wellbore annulus is more susceptible to erosion damage during well production.

In either instance, sand screens are sometimes installed across highly pressurized formations. These formations may be subject to rapid erosion. When a screen is installed in, for example, a high-pressure, high-productivity formation having high permeability streaks, a sand screen can be particularly vulnerable to failure due to sand erosion.

In order to strengthen the sand screen and to protect it from areas of high fluid velocity, or "hot spots," the Maze-Flo™ sand control system has been previously developed. A patent was granted for this technology in 2008 as U.S. Pat. No. 7,464,752. In one embodiment, the technology offers concentric tubular bodies that are dimensioned to be placed in a wellbore along a producing formation. The tubular bodies have alternating sections of perforated (or permeable) pipe and unperforated (or impermeable) pipe.

The tubular bodies include a first perforated base pipe. The first base pipe provides a first fluid flow path within a wellbore. At least one section of the first perforated base pipe is impermeable to fluids, while at least one section of the first perforated base pipe is permeable to fluids. The permeable section is adapted to retain particles larger than a predetermined size while allowing fluids to pass through the permeable section.

The tubular bodies also include a second perforated base pipe inside. The second base pipe provides a second fluid flow path within a wellbore. At least one section of the second perforated base pipe is impermeable to fluids, while at least one section of the second perforated base pipe is permeable to fluids. The permeable section is also adapted to retain particles larger than a predetermined size while allowing fluids to pass through the permeable section.

The at least one permeable section of the first base pipe is in fluid communication with at least one permeable section of the second base pipe. In this way, fluid communication is provided between the first flow path and the second flow path. However, it is preferred that the at least one permeable section of the first base pipe be staggered from the at least one permeable section of the second base pipe.

The MazeFlo™ sand control system offers redundancy for a downhole screen. In this way, if an outer screen fails at any point, sand particles will still be filtered by an inner screen. The incoming sand will deposit on the inner screen and eventually fill up the space between the inner screen and the surrounding outer screen or housing, as the case may be. This significantly reduces the erosion risk on the inner screen by increasing flow resistance. U.S. Pat. No. 7,464,752 is incorporated herein in its entirety by reference.

Despite the success of the MazeFlo™ sand control system, a need exists for further technical developments in this area. Specifically, a need exists for an improved fluid filtering tool that may be used for hydrocarbon production, and that provides redundancy in the filtering media. A need further exists for an improved well screen that quenches hot spots by reducing the velocity of hydrocarbon fluids before they reach the inner screen.

SUMMARY OF THE INVENTION

A sand control device is first provided herein. The sand control device may be used for restricting the flow of particles from a subsurface formation into a tubular body within a wellbore. The sand control device is preferably between about 10 feet (3.05 meters) and 40 feet (12.19 meters) in length.

The sand control device is divided into compartments along its length. For example, the sand control device may have one, two, three, or even more compartments in series. In one aspect, each compartment may be between about 5 feet (1.52 meters) and 30 feet (9.1 meters) in length.

Each compartment first comprises a base pipe. The base pipe defines an elongated tubular body having a permeable section and an impermeable section. Each permeable section may comprise, for example, circular holes or slots for receiving formation fluids into a bore within the base pipe.

Each compartment also comprises a first filtering conduit. The first filtering conduit circumscribes the base pipe and forms a first annular region between the base pipe and the first filtering conduit. The first filtering conduit has a filtering medium around the impermeable section of the base pipe. The filtering medium is constructed to filter sand and other formation particles while allowing an ingress of formation fluids. The filtering medium may be, for example, a wire-wrapped screen or metal mesh screen.

Each compartment also has a second filtering conduit. The second filtering conduit is longitudinally adjacent to the first filtering conduit. The second filtering conduit also circumscribes the base pipe and forms a second annular region between the base pipe and the second filtering conduit. The second filtering conduit defines a filtering medium around the permeable section of the base pipe. The filtering medium is constructed to filter sand and other formation particles while allowing an ingress of formation fluids. Preferably, the filtering medium of the second filtering conduit is a ceramic screen.

In addition, each compartment also includes a tubular housing. The tubular housing is a section of blank pipe that circumscribes the second filtering conduit. The tubular housing forms a third annular region that resides between the second filtering conduit and the surrounding housing.

Each compartment further comprises an in-flow control ring. The in-flow ring is disposed longitudinally between the first filtering conduit and the second filtering conduit. The in-flow ring is configured to direct fluid flow from the first annular region into the third annular region during production.

In one aspect, the in-flow control ring is an under-flow ring. The under-flow ring comprises a short tubular body having an inner diameter and an outer diameter. The outer diameter sealingly receives the blank tubular housing at an end. The under-flow ring preferably has at least two inner ridges that are radially spaced about the inner diameter. The under-flow ring further has flow channels between the at least two inner ridges. The flow channels direct formation fluids into the third annular region.

Optionally, the sand control device further comprises a baffle ring. The baffle ring is disposed between the in-flow ring and the second filtering medium. The baffle ring serves to disperse fluids as the fluids move from the first annular region into the third annular region. The baffle ring defines a tubular body having an inner diameter and an outer diameter. In one aspect, the baffle ring comprises at least two outer ridges radially and equi-distantly spaced about the outer diameter. Flow channels are formed between the at least two outer ridges for dispersing formation fluids as they enter the third annular region. The outer ridges are preferably oriented to the flow channels when the under-flow ring is used.

As an alternative to using an under-flow ring and baffle ring, the in-flow control ring may be an in-flow control device. The in-flow control device also comprises a short tubular body, but includes one or more small through-openings. The through-openings define an area that reduces the pressure of production fluids as they flow from the first annular region into the third annular region.

The compartments are specially configured to reduce fluid flow velocity before production fluids reach the permeable section of the base pipe. This may be done in one of several ways, such as: (i) using an under-flow ring or other flow-altering device to reduce the flow-energy in the fluid, (ii) using an in-flow control device (ICD) (in lieu of or in conjunction with the under-flow ring), wherein the in-flow control device has a relatively small through-openings or orifices that are tuned to provide a desired pressure drop, (iii) extending the length of the impermeable section of the base pipe between the non-overlapping in-flow control ring and the permeable section of the base pipe, either before or after the point where wellbore fluids will reach the second filtering conduit, (iv) increasing the radial clearance of the second annular region (and thereby decreasing the radial clearance of the third annular region), (v) providing an in-flow control device along the second annular region, (vi) placing a porous medium within the third annular region, or (vi) combinations thereof.

In one embodiment, the at least one compartment further comprises a third filtering section. The third filtering section is a mirror image of the first filtering section, and is placed at an end of the second filtering conduit opposite the first filtering conduit. In other words, the second filtering conduit is threaded between two first filtering conduits. In this way, inflow to the second filtering conduit is split between two primary filtering conduits.

A method for completing a wellbore in a subsurface formation is also provided herein. In one embodiment, the method first includes providing a sand control device. The sand control device is designed in accordance with the sand control device described above, in its various embodiments.

The method also includes running the sand control device into a wellbore. The sand control device is lowered to a selected subsurface location. The sand control device thereby forms an annulus in the wellbore between the sand control device and the surrounding wellbore.

The sand control device may be run into a new wellbore as a stand-alone screen. Alternatively, the sand control device may be placed in the wellbore along with a gravel pack. In this latter arrangement, the method further includes injecting a gravel slurry into the wellbore. The gravel slurry is injected in order to form a gravel pack in the annulus between the sand control device and the surrounding formation.

The base pipe is preferably in fluid communication with a string of production tubing used for transporting hydrocarbons from the wellbore to the surface. In this instance, the flow channels of the under-flow ring are oriented to direct the flow of production fluids from the first annular region into the third annular region, then through the second annular region and into the base pipe, and then up to surface via the production tubing during a production operation.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 8A provides a cross-sectional view of a portion of a sand screen disposed along an open-hole portion of a wellbore. A gravel pack has been placed around the sand screen and within the surrounding open-hole formation.

FIG. 8B is a cross-sectional view of the sand screen of FIG. 8A, taken across line B-B of FIG. 8A. Alternate flow channels are seen internal to the screen.

FIG. 8C is another cross-sectional view of the sand screen of FIG. 8A. This view is taken across line C-C of FIG. 8A.

DETAILED DESCRIPTION OF CERTAIN EMBODIMENTS

Definitions

Figure 1:
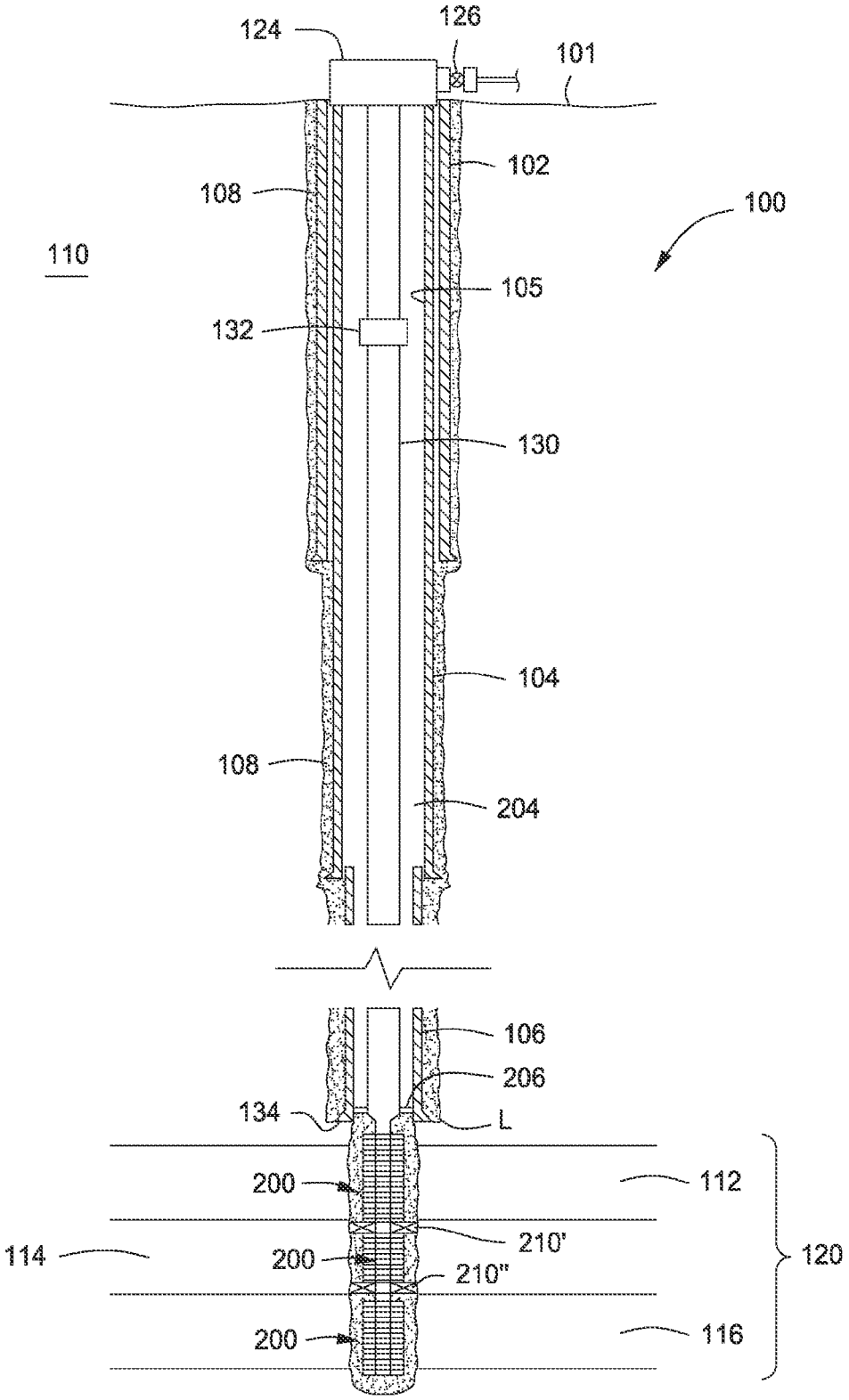
FIG. 1 is a cross-sectional view of an illustrative wellbore. The wellbore has been drilled through three different subsurface intervals, each interval being under formation pressure and containing fluids.

As used herein, the term "hydrocarbon" refers to an organic compound that includes primarily, if not exclusively, the elements hydrogen and carbon. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

The term "subsurface formation" refers to a formation or a portion of a formation wherein formation fluids may reside. The fluids may be, for example, hydrocarbon liquids, hydrocarbon gases, aqueous fluids, or combinations thereof.

As used herein, the term "wellbore" refers to a hole in the subsurface made by drilling or insertion of a conduit into the subsurface. A wellbore may have a substantially circular cross section, or other cross-sectional shape. As used herein, the term "well", when referring to an opening in the formation, may be used interchangeably with the term "wellbore."

The term "tubular member" or "tubular body" refers to any pipe, such as a joint of casing, a tubing, a portion of a liner, or a pup joint.

The term "sand control device" means any elongated tubular body that permits an inflow of fluid into an inner bore or a base pipe while filtering out predetermined sizes of sand, fines and granular debris from a surrounding formation. A wire-wrapped screen is an example of a sand control device.

The term "alternate flow channel" means any collection of manifolds and/or shunt tubes that provide fluid communication through or around a packer to allow a gravel slurry to by-pass the packer elements or any premature sand bridge in the annular region, and to continue gravel packing further downstream. The term "alternate flow channels" can also mean any collection of manifolds and/or shunt tubes that provide fluid communication through or around a sand control device or a tubular member (with or without outer protective shroud) to allow a gravel slurry to by-pass any premature sand bridge in the annular region and continue gravel packing below, or above and below, the premature sand bridge or any downhole tool.

DESCRIPTION OF SPECIFIC EMBODIMENTS

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1 is a cross-sectional view of an illustrative wellbore 100. The wellbore 100 defines a bore 105 that extends from a surface 101, and into the earth's subsurface 110. The wellbore 100 is completed to have an open-hole portion 120 at a lower end of the wellbore 100. The wellbore 100 has been formed for the purpose of producing hydrocarbons for commercial sale. A string of production tubing 130 is provided in the bore 105 to transport production fluids from the open-hole portion 120 up to the surface 101.

In the illustrative wellbore 100, the open-hole portion 120 traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. This may be due to the presence of native water zones, high permeability streaks or natural fractures in the aquifer, or fingering from injection wells. In this instance, there is a probability that water will invade the wellbore 100.

Alternatively, upper 112 and intermediate 114 intervals may contain hydrocarbon fluids sought to be produced, processed and sold, while lower interval 116 may contain some oil along with ever-increasing amounts of water. This may be due to coning, which is a rise of near-well hydrocarbon-water contact. In this instance, there is again the possibility that water will invade the wellbore 100.

Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

The wellbore 100 includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or catastrophic event at the surface or above the subsurface safety valve 132. The wellbore 100 may optionally have a pump (not shown) within or just above the open-hole portion 120 to artificially lift production fluids from the open-hole portion 120 up to the well tree 124.

The wellbore 100 has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100. Intermediate casing strings 104, 106 may be hung from the surface, or they may be hung from a next higher casing string using an expandable liner or liner hanger. It is understood that a pipe string that does not extend back to the surface (such as casing string 106) is normally referred to as a "liner."

In the illustrative wellbore arrangement of FIG. 1, intermediate casing string 104 is hung from the surface 101, while casing string 106 is hung from a lower end of casing string 104. Additional intermediate casing strings (not shown) may be employed. The present inventions are not limited to the type of casing arrangement used.

Each string of casing 102, 104, 106 is set in place through cement 108. The cement 108 isolates the various formations of the subsurface 110 from the wellbore 100 and each other. The cement 108 extends from the surface 101 to a depth "L" at a lower end of the casing string 106. It is understood that some intermediate casing strings may not be fully cemented.

An annular region 204 is formed between the production tubing 130 and the surrounding casing string 104, 106. A production packer 206 seals the annular region 204 near the lower end "L" of the casing string (or liner) 106.

In many wellbores, a final casing string known as production casing is cemented into place at a depth where subsurface production intervals reside. However, the illustrative wellbore 100 is completed as an open-hole wellbore. Accordingly, the wellbore 100 does not include a final casing string along the open-hole portion 120.

In connection with the production of hydrocarbon fluids from a wellbore having an open-hole completion 120, it is desirable to limit the influx of sand particles and other fines. In order to prevent the migration of formation particles into the production string 130 during operation, sand control devices 200 have been run into the wellbore 100.

Figure 2:
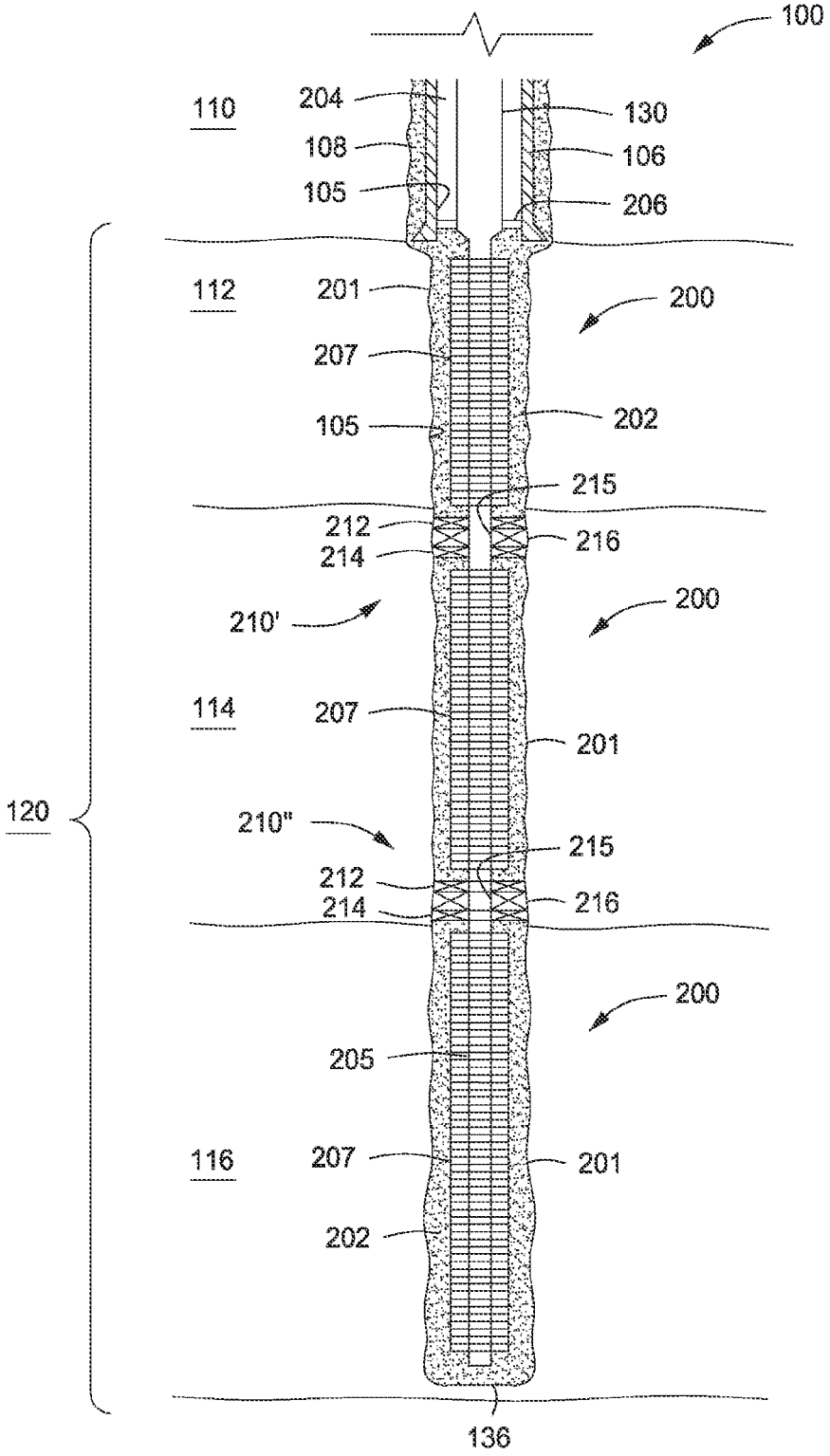
FIG. 2 is an enlarged cross-sectional view of an open-hole completion of the wellbore of FIG. 1. The open-hole completion at the depth of the three illustrative intervals is more clearly seen.

FIG. 2 provides an enlarged cross-sectional view of the open-hole portion 120 of the wellbore 100 of FIG. 1. The sand control devices 200 are more clearly seen. Each of the sand control devices 200 contains an elongated tubular body referred to as a base pipe 205. The base pipe 205 typically is made up of a plurality of pipe joints. The base pipe 205 (or each pipe joint making up the base pipe 205) typically has small perforations or slots to permit the inflow of production fluids.

The sand control devices 200 also contain a filter medium 207 wound or otherwise placed radially around the base pipes 205. The filter medium 207 may be a wire mesh screen or wire wrap fitted around the base pipe 205. Alternatively, the filtering medium of the sand screen comprises a membrane screen, an expandable screen, a sintered metal screen, a porous media made of shape-memory polymer, a porous media packed with fibrous material, or a pre-packed solid particle bed. The filter medium 207 prevents the inflow of sand or other particles above a pre-determined size into the base pipe 205 and the production tubing 130.

In addition to the sand control devices 200, the wellbore 100 includes one or more optional packer assemblies 210. In the illustrative arrangement of FIGS. 1 and 2, the wellbore 100 has an upper packer assembly 210' and a lower packer assembly 210". However, additional packer assemblies 210 or just one packer assembly 210 may be used. The packer assemblies 210', 210" are uniquely configured to seal an annular region 202 between the various sand control devices 200 and a surrounding wall 201 of the open-hole portion 120 of the wellbore 100. Further, the illustrative packer assemblies 210', 210" are positioned to isolate the annular region 202 above and below the intermediate interval 114.

Each packer assembly 210', 210" may have at least two packers. The packers are preferably set through a combination of mechanical manipulation and hydraulic forces. The packer assemblies 210 represent an upper packer 212 and a lower packer 214. Each packer 212, 214 has an expandable portion or element fabricated from an elastomeric or a thermoplastic material capable of providing at least a temporary fluid seal against the surrounding wellbore wall 201.

The elements for the upper 212 and lower 214 packers should be able to withstand the pressures and loads associated with a gravel packing process. Typically, such pressures are from about 2,000 psi to 3,000 psi. The elements for the packers 212, 214 should also withstand pressure load due to differential wellbore and/or reservoir pressures caused by natural faults, depletion, production, or injection. The elements for the packers 212, 214 are preferably cup-type elements. In one embodiment, the cup-type elements need not be liquid tight, nor must they be rated to handle multiple pressure and temperature cycles. The cup-type elements need only be designed for one-time use, to wit, during the gravel packing process of an open-hole wellbore completion. This is because an intermediate swellable packer element 216 is also preferably provided for long term sealing.

The optional intermediate packer element 216 defines a swelling elastomeric material fabricated from synthetic rubber compounds. Suitable examples of swellable materials may be found in Easy Well Solutions' Constrictor® or SwellPacker®, and SwellFix's E-ZIP™. The swellable packer 216 may include a swellable polymer or swellable polymer material, which is known by those skilled in the art and which may be set by one of a conditioned drilling fluid, a completion fluid, a production fluid, an injection fluid, a stimulation fluid, or any combination thereof.

A mandrel 215 is shown running through the packers 212, 214. The swellable packer element 216 is preferably bonded to the outer surface of the mandrel 215. The swellable packer element 216 is allowed to expand over time when contacted by hydrocarbon fluids, formation water, or other actuating fluid. As the packer element 216 expands, it forms a fluid seal with the surrounding zone, e.g., interval 114.

The upper 212 and lower 214 packers are set prior to a gravel pack installation process. The mechanically set packers 212, 214 are preferably set in a water-based gravel pack fluid that would be diverted around the swellable packer element 216, such as through shunt tubes (not shown in FIG. 2). If only a hydrocarbon swelling elastomer is used, expansion of the element may not occur until after the failure of either of the elements in the mechanically set packers 212, 214.

The packer assemblies 210', 210" help control and manage fluids produced from different zones. In this respect, the packer assemblies 210', 210" allow the operator to seal off an interval from either production or injection, depending on well function. Installation of the packer assemblies 210', 210" in the initial completion further allows an operator to shut-off the production from one or more zones during the well lifetime to limit the production of water or, in some instances, an undesirable non-condensable fluid such as hydrogen sulfide. The operator may set a plug within the tubing 130 adjacent packer assembly 210" to seal off the lower interval 116. Alternatively, the operator may place a straddle packer within the tubing 130 across each of the two packer assemblies 210', 210" to seal off production from the intermediate interval 114.

Figure 3A:
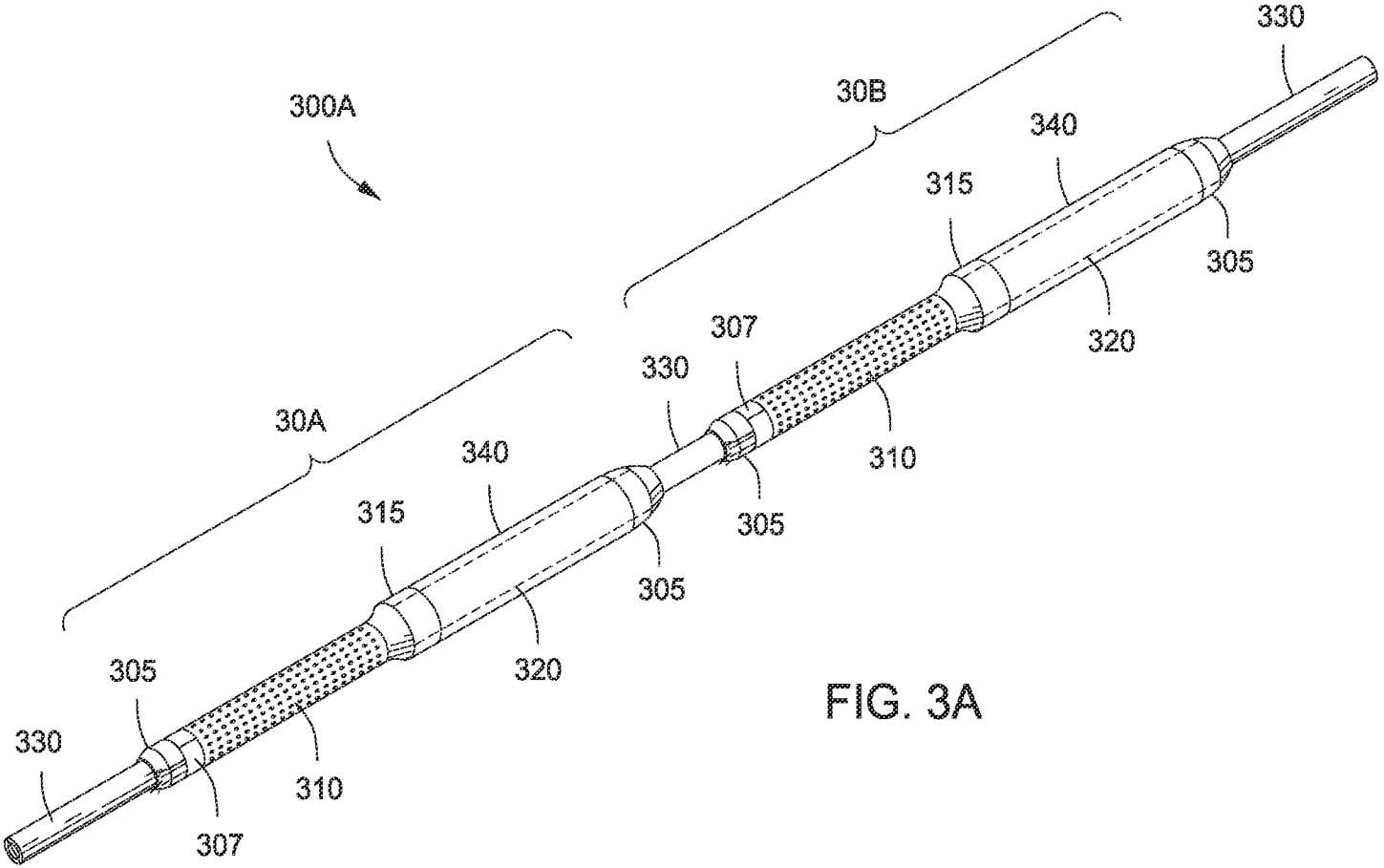
FIG. 3A is a perspective view of a sand screen according to the present invention, in one embodiment. Two "compartments" of the sand screen are seen in series, each compartment having two filtering sections.

Referring now to FIG. 3A, FIG. 3A is a perspective view of a sand screen 300A according to the present invention, in one embodiment. The illustrative sand screen 300A presents one arrangement for the sand screen joints 200 of FIGS. 1 and 2. The sand screen 300A defines an elongated tubular body. More specifically, the sand screen 300A defines a series of pipe joints that are circumferentially disposed within another series of pipe joints for receiving formation fluids.

The sand screen 300A exists for the purpose of filtering formation particles, e.g., clay particles and sand, from the formation fluids. The sand screen 300A may be placed in a wellbore that is completed substantially vertically, such as wellbore 100 of FIG. 1. Alternatively, the sand screen 300A may be placed longitudinally along a formation that is completed horizontally or that is otherwise deviated. As formation fluids enter the wellbore, the fluids travel into the sand screen 300A under pressure. The fluids then progress to the surface. The surface may be a land surface such as shown at surface 101 in FIG. 1; alternatively, the surface may be a water surface in an ocean (not shown).

Along the sand screen 300A are filtering sections. The filtering sections are divided into primary sections 310 and secondary sections 320. In the arrangement of FIG. 3A, two groupings of primary 310 and secondary 320 filtering sections are indicated. Each of these groupings represents a "compartment." The compartments are indicated at 30A and 30B.

It may be preferred that a wellbore be completed with a plurality of sand screen joints 300A, with each joint normally being between 10 feet (3 meters) and 45 feet (14 meters). Each sand screen 300A has at least one compartment, 30A or 30B. In the case of one compartment, the compartment length can be up to the length of screen 300A. It may also be preferred that each sand screen joint have at least two sand screen compartments 30A and 30B, or 30C such as three sand screen compartments per joint 30A, 30B, and/or 30C, and in some embodiment up to six compartments 30A per joint 300A. For example, each compartment may be between about 5 feet (1.52 meters) and 10 feet (3.05 meters) in length.

In one arrangement, the sand screen 300A is 30 feet (9.14 meters) long, and comprises a first primary section, followed by a first secondary section, followed by a second primary section, followed by a second secondary section, with each of these four sections being about six feet in length. The remaining six feet is taken up by under-flow rings 315, baffles (such as baffle 350 of FIGS. 4B and 7), threaded connection ends (not shown) and extensions of blank pipe. The extensions of blank pipe would be for baffle extensions, compartment dividers, and connection make-up in field installation.

It is understood that numerous combinations of tubular sections may be employed. The present invention is not limited by dimensions or the number of compartments used unless expressly stated in the claims herein.

In order to transport fluids to the surface 101, the sand screen 300A includes a base pipe. The base pipe is not visible in the view of FIG. 3A; however, the base pipe is shown at 335*b* in FIG. 4A, and at 335*p* in FIG. 4B. As will be discussed more fully below, base pipe 335*b* represents a section of blank pipe, while base pipe 335*p* is a section of perforated or slotted pipe. The base pipes 335*b* and 335*p* transport formation fluids towards the surface 101.

To effectuate the transport of formation fluids to the surface 101, the base pipes 335*b*, 335*p* are in fluid communication with a tubular body 330. The tubular body 330 represents sections of "blank" tubular members. The base pipes 335*b*, 335*p* and the tubular body 330 may be the same tubular member. The tubular body 330, in turn, is in fluid communication with the production tubing 130 (shown in FIGS. 1 and 2). The tubular body 330 is threadedly connected to the production tubing 130 at or below the packer 206 to form a fluid conduit that delivers production fluids to the surface 101. In practice, the tubular body 330 may actually be sections of production tubing 130. The tubular body 330 may alternatively be a section of a tubular body threadedly connected to the screen 300A.

Portions of the tubular body 330 extend from either or both ends of the compartments 30A, 30B. Split rings 305 are applied at opposing ends of the compartments 30A, 30B to create a seal between the compartments 30A, 30B and the tubular body 330. The split rings 305 are shown in and described more fully in connection with FIGS. 5A through 5C, below.

In the sand screen 300A, the filtering function of the screen 300A is substantially continuous along the tool's length. However, the filtering media of the screen 300A are not continuous; rather sections of blank base pipe 335*b* and perforated base pipe 335*p* are staggered with primary 310*f* and secondary 320*f* filtering conduits (not shown in FIG. 3A). In this way, if a portion of the filtering medium in the primary filtering section 310 fails, movement of sand will nevertheless be filtered before entering the perforated base pipe 335*p*. In this respect, formation fluids are still forced to flow along the blank base pipe 335*b* and towards the secondary section 320, where the fluids will then pass through the filtering medium 320*f* of the secondary filtering section 320 before entering the perforated base pipe 335*p*.

Figure 3B:
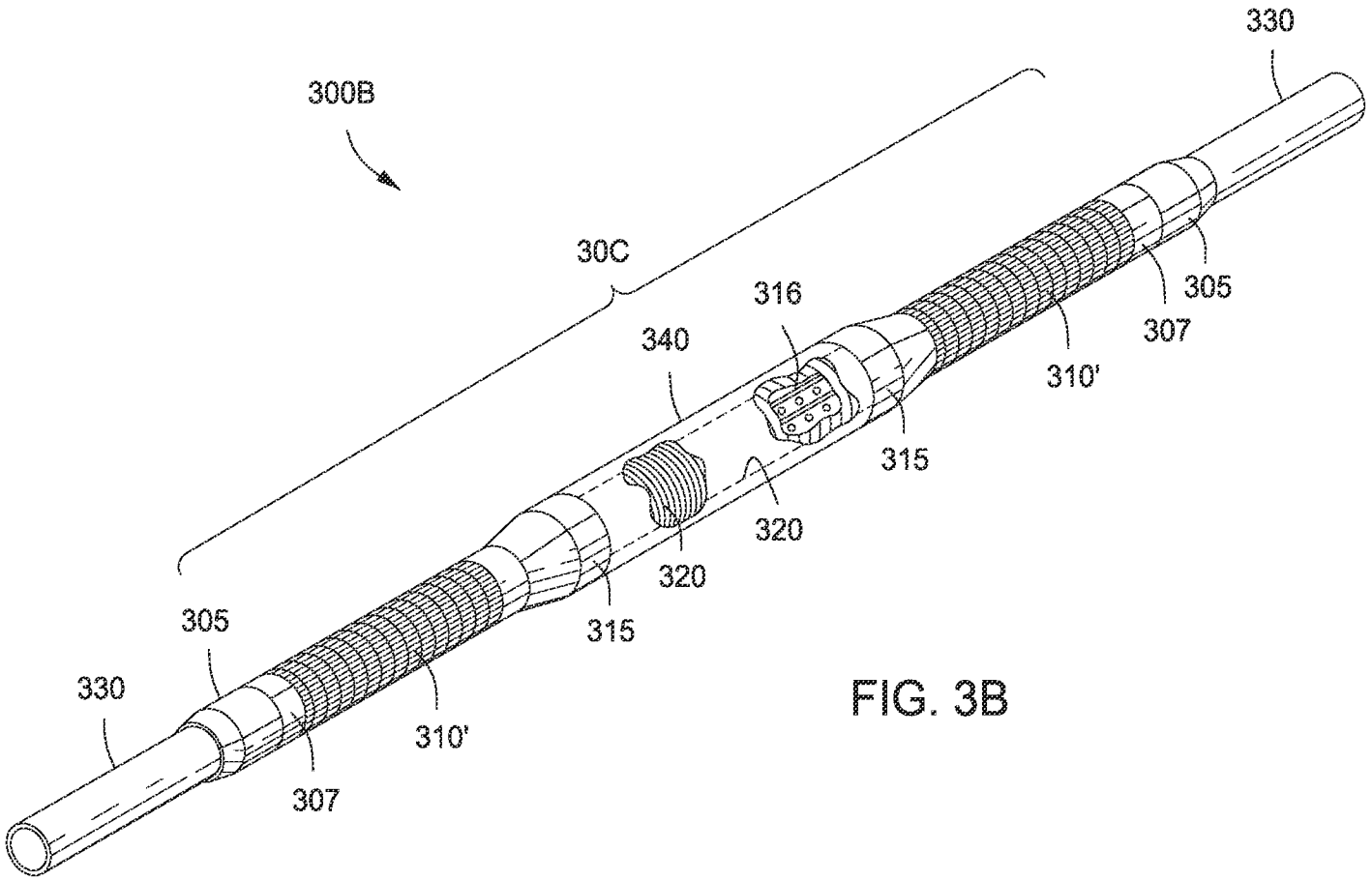
FIG. 3B is a perspective view of a sand screen according to the present invention, in an alternate embodiment. Here, one compartment having three filtering sections is shown. One filtering section is shown in cut-away view.

FIG. 3B is a perspective view of a sand screen 300B, in an alternate embodiment. Here, a single compartment 30C is shown. The compartment 30C has three distinct filtering sections 310'/320/310'. Filtering sections 310' represent primary filtering sections, while filtering section 320 is a secondary filtering section.

Filtering sections 310' in FIG. 3B are similar to filtering section 310 of FIG. 3A. In this respect, filtering sections 310' employ tubular conduits 310*f* that serve as the filtering media for the primary filtering sections 310'. In FIG. 3B, the illustrative filtering conduits 310*f* each define a wire mesh. The filtering conduits 310*f* are disposed at opposing ends of the secondary filtering section 320. In this way, inflow into the compartment 30C is split between two primary filtering sections 310', thereby reducing fluid velocity approaching the secondary filtering section 320.

Filtering section 320 in FIG. 3B is similar to filtering section 320 of FIG. 3A. In this respect, filtering section 320 of FIG. 3B includes a tubular filtering conduit 320*f* that serves as the filtering media for the secondary filtering section 320. In FIG. 3B, the illustrative filtering conduit 320*f* defines a ceramic screen. Ceramic screens are available from ESK Ceramics GmbH & Co. of Germany. The screens are sold under the trade name PetroCeram®. The secondary filtering section 320 also includes a housing 340 around the second filtering conduit 320*f*. The filtering conduit 320*f* can also be a wire-wrap screen or a mesh screen.

Figure 4A:
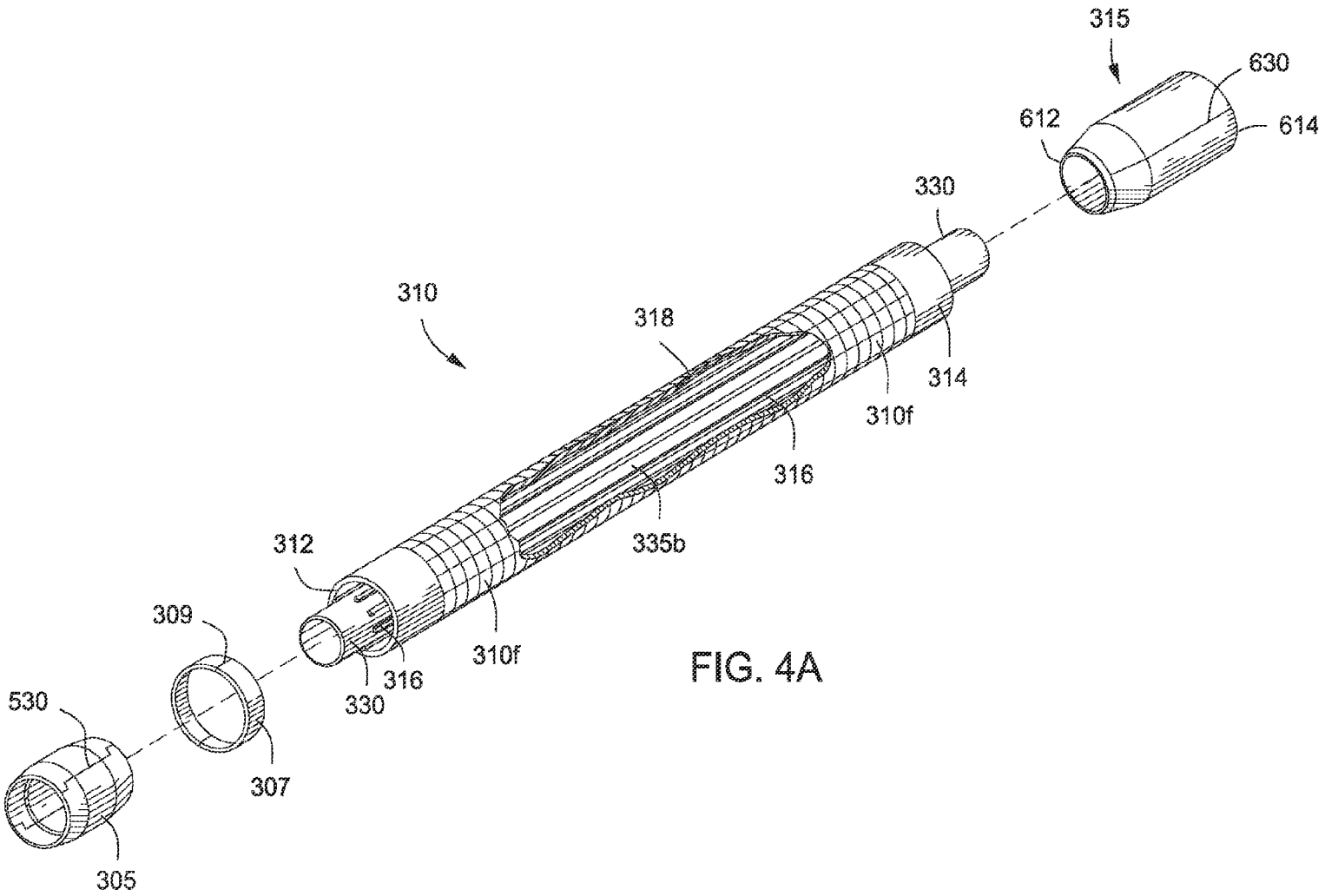
FIG. 4A is a perspective view of a portion of the sand screen of FIG. 3A or 3B. In this view, a split-ring, a welding ring, a primary filtering section, and an under-flow ring are shown exploded apart. A portion of the primary filtering section is cut-away, exposing a non-perforated base pipe there along.

FIG. 4A provides an exploded perspective view of a portion of the sand screen 300B of FIG. 3B. Specifically, the primary filtering section 310 of the sand screen 300B is seen. The primary section 310' first includes the elongated base pipe 335*b*. As can be seen, this section of base pipe 335*b* is blank pipe.

Circumscribing the base pipe 335*b* is a filtering conduit 310*f*. The filtering conduit 310*f* defines a filtering medium substantially along its length, and serves as a primary permeable section. A portion of the filtering conduit 310*f* is cut-away, exposing the blank (non-perforated) base pipe 335*b* there along. Longitudinal ribs 316 are also shown providing clearance for the surrounding filtering conduit 310*f*.

The filtering medium for the filtering conduit 310*f* may be a wire mesh screen (as seen in FIG. 3B). Alternatively, and as shown in the illustrative arrangement of FIG. 4B, the filtering medium is a wire wrapped screen. The wire mesh screen creates a matrix that permits an ingress of formation fluids while restricting the passage of sand particles over a certain gauge.

The filtering conduit 310*f* is preferably placed around the base pipe 335*b* in a substantially concentric manner. The filtering conduit 310*f* has a first end 312 and a second end 314. The first 312 and second 314 ends are optionally tapered down to a smaller outer diameter. In this way, the ends 312, 314 may be welded to connector parts that control the flow of formation fluids in an annular region 318 between the non-perforated base pipe 335*b* and the surrounding filtering conduit 310*f*.

In FIG. 4A, the wire mesh screen extends substantially along the length of the filtering section 310'. Optionally, longitudinal ribs 316 provide spacing between the base pipe 335*b* and the surrounding screen 310*f* as is known in the art. Optionally, the wire mesh matrix extends all the way to opposing ends 312 and 314 to maximize flow coverage.

In the arrangement of FIG. 4A, the primary section 310' includes a split-ring 305. The split-ring 305 is dimensioned to be received over the tubular body 330, and then abut against the first end 312 of the filtering conduit 310*f*. FIG. 5A provides an enlarged perspective view of the split-ring 305 of FIG. 4A. The illustrative split-ring 305 defines a short tubular body 510, forming a bore 505 therethrough.

The split-ring 305 has a first end 512 and a second end 514. The split-ring 305 is preferably formed by joining two semi-spherical pieces together. In FIG. 5A, two seams 530 are seen running from the first end 512 to the second end 514.

Figure 5B:
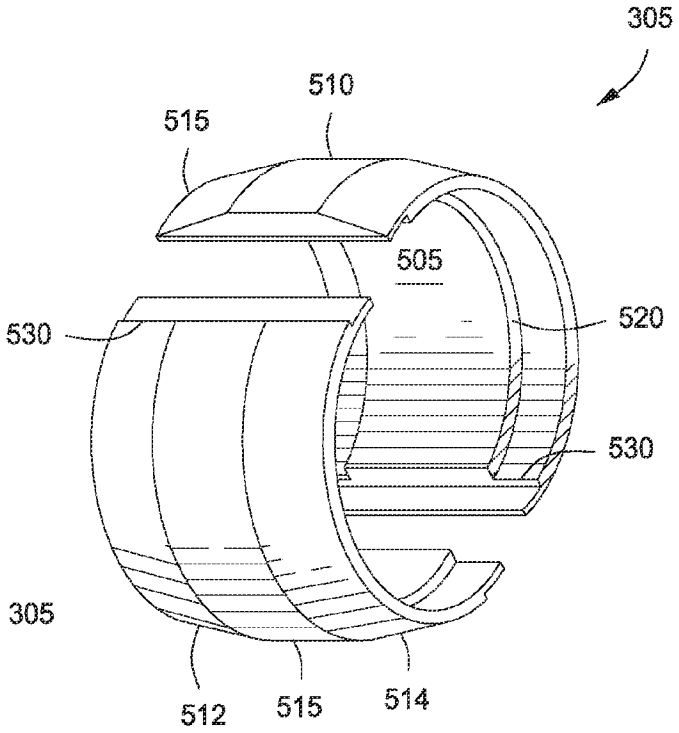
FIG. 5B is a perspective view of the split-ring of FIG. 5A. The split-ring is shown as being separated along the two seams for illustrative purposes.
Figure 5A:
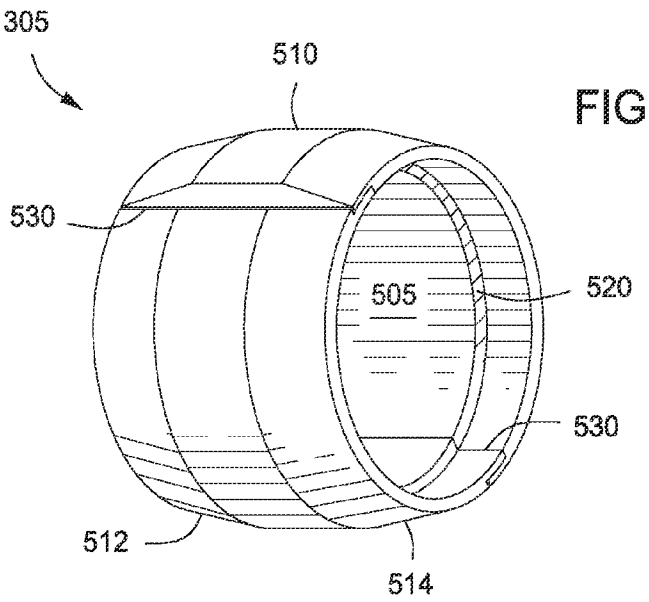
FIG. 5A is a perspective view of a split-ring as may be used for connecting components of the sand screen of FIG. 4A and FIG. 4B. The illustrative split-ring has two seams.

FIG. 5B presents another perspective view of the split-ring 305 of FIG. 5A. Here, the split-ring 305 is shown as separated along the two seams 530. During fabrication, two semi-spherical pieces 515 are placed over the tubular body 330 and abutted against the filtering conduit 310*f* at the first end 312. The joined semi-spherical pieces 515 are then welded together, and may also be optionally welded to the first end 312 of the primary filtering conduit 310*f*. The semi-spherical pieces 515 may also be welded to the non-perforated base pipe 335*b* or to the tubular body 330

In order to seal the annular region 318 between the non-perforated base pipe 335*b* and the surrounding filtering conduit 310*f*, a shoulder 520 is placed along the bore 505 of the split-ring 305. The shoulder 520 is abutted on the filtering conduit 310*f* and is sized to at least partially fill the annular region 318. The larger internal diameter of the split-ring 305 between the shoulder 520 and the second end 514 is sized to closely fit around the filter medium of the filtering conduit 310*f* near the first end 312. The close fit prevents a pre-determined size of particles from entering a gap (not indicated) between the split-ring 305 and the filter medium. The split-ring 305 thus helps to prevent the flow of formation fluids into the annular region 318 without first passing through the filter medium of the filtering conduit 310*f*.

It is noted that each end 512, 514 of the split-ring 305 will preferably have a shoulder 520. A short tubular sub (not shown) may be inserted into the bore 505 of the split-ring 305 opposite the filtering conduit 310*f*. The sub will have a threaded end for threadedly connecting to a packer, another compartment of the sand control joint 300, a section of blank pipe, or any another tubular body desired for completing the wellbore.

Figure 5C:
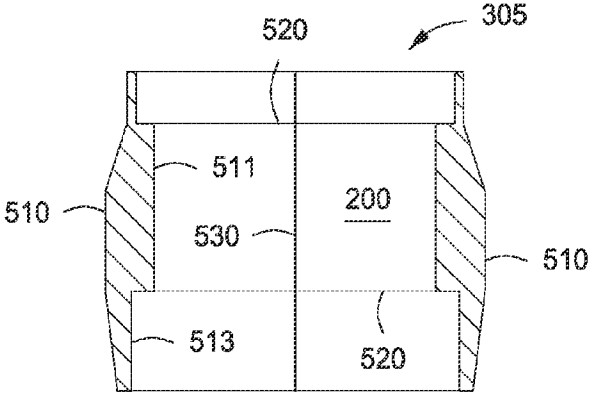
FIG. 5C is a cross-sectional view of the split-ring of FIG. 5A, taken across the length of the ring.

FIG. 5C is a cross-sectional view of the split-ring 305 of FIG. 5A, taken across the minor axis. Here, the wall 510 of the split-ring 305 is seen, with the bore 505 formed within the wall 510. Also visible are reference numbers 511 and 513, showing narrow diameter and wider diameter portions of the split-ring 305, respectively. Shoulder 520 is more clearly seen.

FIG. 4A also shows a welding ring 307. The welding ring 307 is an optional circular body that offers additional welding stock. In this way, the filtering conduit 310*f* may be sealingly connected to the welding ring 307. The welding ring 307 may have seams 309 that allow the welding ring 307 to be placed over the tubular body 330 for welding. Optional welding rings 307 are also shown in FIGS. 3A and 3B adjacent split-rings 305.

FIG. 4A also shows an under-flow ring 315. In a production mode, the under-flow ring 315 is designed to receive formation fluids as they flow out of the annular region 318 of the primary section 310 and en route to the secondary section 320. The under-flow ring 315 is shown exploded apart from the second end 314 of the filtering conduit 310*f*.

Figure 6B:
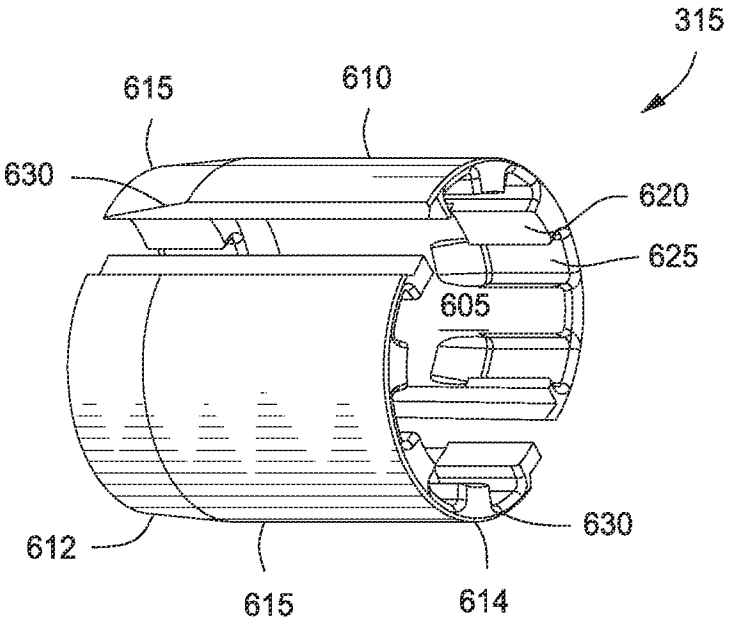
FIG. 6B is a perspective view of the under-flow ring of FIG. 6A. The under-flow ring is shown as being separated along the two seams for illustrative purposes.
Figure 6A:
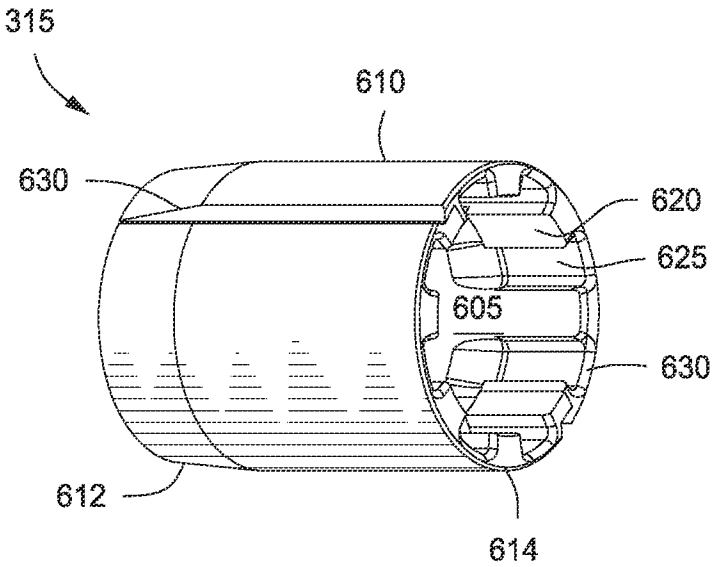
FIG. 6A is a perspective view of an under-flow ring as may be used for fluidly connecting the primary and secondary sections of the sand screen of FIGS. 4A and 4B. The illustrative under-flow ring has two seams.

FIG. 6A provides an enlarged perspective view of the under-flow ring 315 of FIG. 4A. The illustrative under-flow ring 315 defines a short tubular body 610, forming a bore 605 therethrough.

The under-flow ring 315 has a first end 612 and a second end 614. The under-flow ring 315 is preferably formed by joining two semi-spherical pieces together. In FIG. 6A, two seams 630 are seen running from the first end 612 to the second end 614.

FIG. 6B presents another perspective view of the under-flow-ring 315 of FIG. 6A. Here, the under-flow ring 315 is shown as being separated along the two seams 630. During fabrication, two semi-spherical pieces 615 are placed over the outer diameter of a filtering conduit 310*f* of an adjoining primary section 310 at the second end 314. The joined semi-spherical pieces 615 are then welded together, and also welded to the base pipe 335*b* or the tubular body 330 next to the second end 314 of the filtering conduit 310*f* to form an annular seal.

Figure 6C:
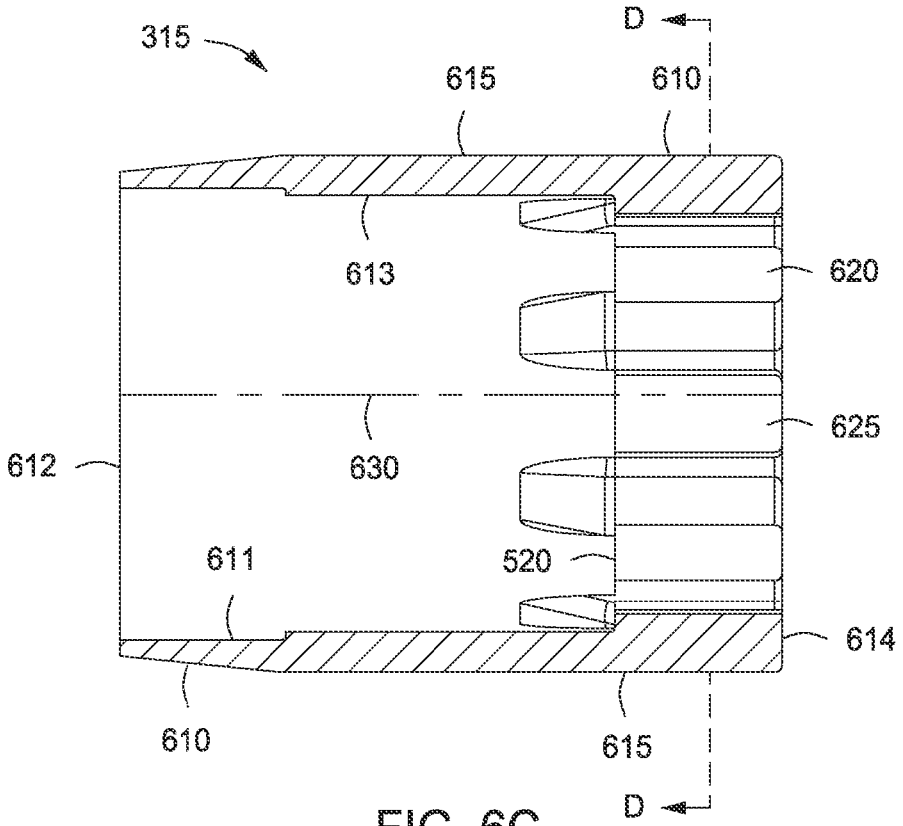
FIG. 6C is a cross-sectional view of the under-flow ring of FIG. 6A, taken across the length of the ring.
Figure 6D:
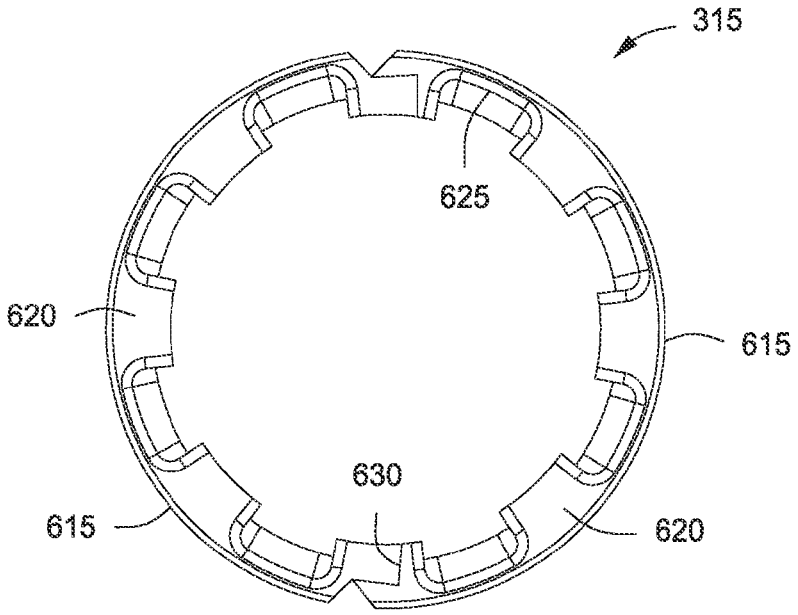
FIG. 6D is another cross-sectional view of the under-flow ring of FIG. 6A, this one taken across line D-D of FIG. 6C.

FIG. 6C is a cross-sectional view of the under-flow ring 315 of FIG. 6A, taken across the length of the ring 315. The seam 630 joining the two semi-spherical pieces 615 is seen. FIG. 6D is another cross-sectional view of the under-flow ring of FIG. 6A, this one taken across line D-D of FIG. 6C.

In order to seal the annular region 318 between the non-perforated base pipe 335*b* and the surrounding filtering conduit 310*f* at the second end 314 of the filtering conduit 310*f*, a shoulder (not seen in FIG. 3A or 3B) similar to 520 in FIG. 5A is placed along the bore 605 of the under-flow ring 315 near the first end 612. The shoulder is abutted on the filter medium of filtering conduit 310*f* and sized to at least partially open the bore 605 to the annular region 318. The larger bore diameter of underflow-ring 315 between the shoulder and the first end 612 is sized to closely fit around the filter medium of the filtering conduit 310*f* near the second end 314. The close fit prevents a pre-determined size of particles from entering the gap between the under-flow ring and the filter medium of the filtering conduit 310*f*. The underflow ring 315 prevents the flow of formation fluids into the annular region 318 without first passing the filter medium of the filtering conduit 310*f*.

The under-flow ring 315 includes a plurality of inner ridges 620 near the second end 614. The ridges 620 are radially and equi-distantly spaced along an inner diameter of the under-flow ring 315. The inner ridges 620 form flow channels 625 there between. The flow channels 625 receive formation fluids as they leave the annular region 318 of the primary section 310 and enter the secondary section 320 of the sand screen joint 300.

The formation fluids enter the first end 612 of the under-flow ring 315, and are released from the second end 614. From there, the formation fluids flow over the filtering conduit 320*f* of the secondary section 320.

Figure 4B:
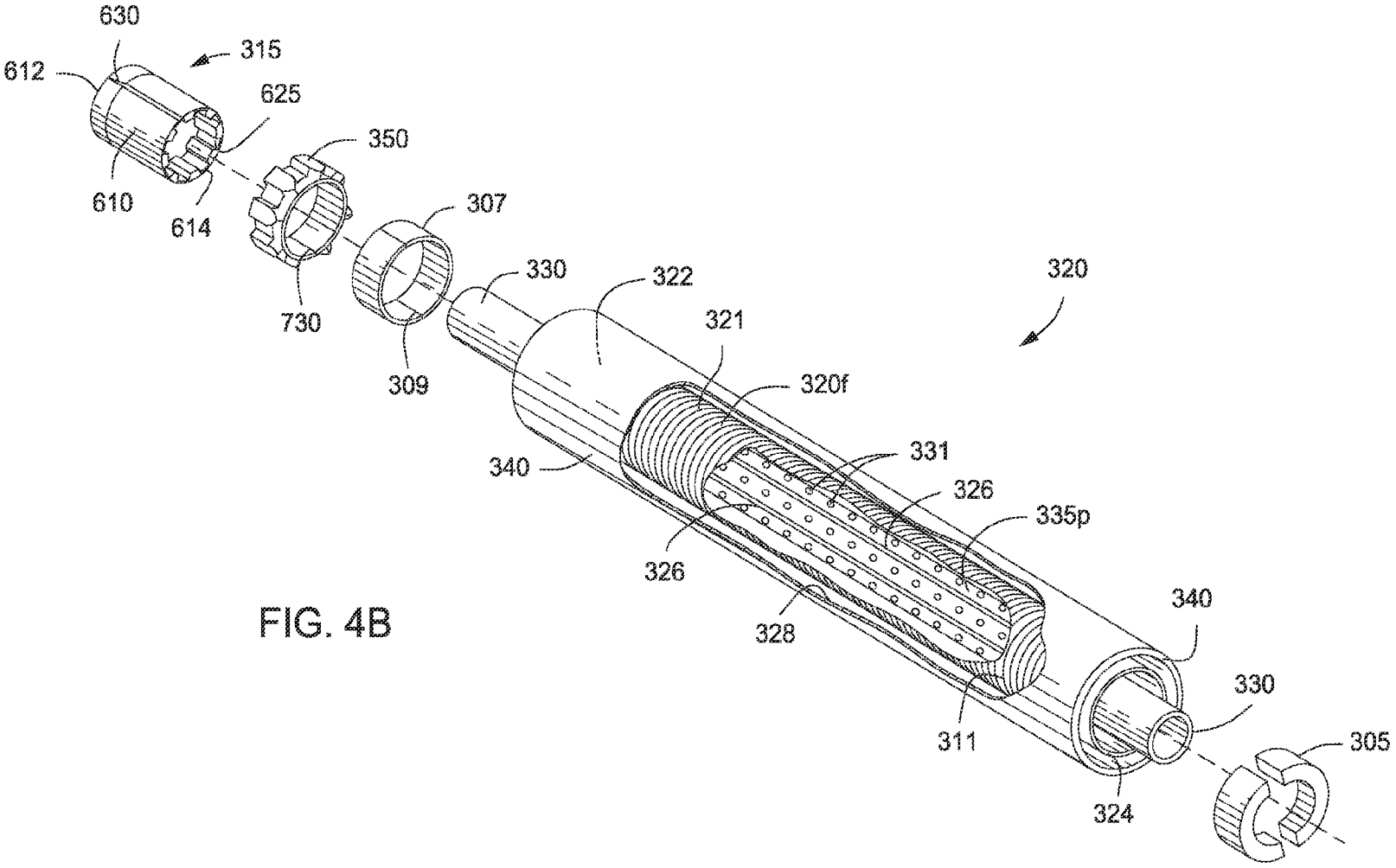
FIG. 4B is another perspective view of a portion of the sand screen of FIG. 3A or 3B. In this view, an under-flow ring, a baffle ring, a welding ring, and a secondary filtering section are shown exploded apart. A portion of the secondary filtering section is cut-away, exposing a perforated base pipe there along.

FIG. 4B is an exploded perspective view of another portion of the sand screen 300B of FIG. 3B. Specifically, the secondary section 320 of the sand screen 300B is seen. The secondary section 320 first includes the elongated base pipe 335*p*. As can be seen, this section of base pipe 335*p* is perforated. Alternatively, the base pipe 335*p* may have slots or other fluid ports. In FIG. 4B, fluid ports are seen at 331.

Circumscribing the base pipe 335*p* is the secondary filtering conduit 320*f*. The filtering conduit 320*f* also includes a filtering medium. The filtering conduit 320*f* serves as a secondary permeable section. A portion of the filtering conduit 320*f* is cut-away, exposing the perforated base pipe 335*p* there-along. The filtering medium of the illustrative filtering conduit 320*f* is a wire-wrapped screen, although it could alternatively be a wire-mesh. The wire-wrapped screen provides a plurality of small helical openings 321. The helical openings 321 are sized to permit an ingress of formation fluids while restricting the passage of sand particles over a certain gauge.

The second filtering conduit 320*f* has a first end 322 and a second end 324. The first 322 and second 324 ends are optionally tapered down to a smaller outer diameter. In this way, the ends 322, 324 may be welded to connector parts 305, 307, 315 that control the flow of formation fluids in an annular region 328 between the filtering conduit 320*f* and a surrounding housing 340.

Longitudinal ribs 326 are provided along the base pipe 335*p*. The ribs 326 provide a determined spacing or height between the permeable section of base pipe 335*p* and the surrounding secondary filtering conduit 320*f*.

In FIG. 4B, the under-flow ring 315 is again seen. Here, the second end 614 of the under-flow ring 315 is to be connected proximate the first end 322 of the filtering conduit 320*f*. Specifically, an inner diameter of the housing 340 is welded onto an outer diameter of the body 610 of the under-flow ring 315. In this way, formation fluids are sealingly delivered from the annular region 318, through the flow channels 625, and into the annular region 328.

The under-flow rings 315 seal the open ends of the annular region 328. The under-flow rings are welded on the base pipe 338*b*, and provide a flow transit from the annular region 318 to the annular region 328. The under-flow rings convert annular flow from the first conduit to about eight circumferentially-spaced flow ports. The under-flow rings 315 also provide support for the housing 340 via welding.

In the production mode, it is desirable to disperse the formation fluids circumferentially around the annular region 328. In this way, fluid flow is more uniform as it flows over and through the filtering conduit 320*f*. Accordingly, the second section 320 also optionally includes a baffle ring 350. The baffle ring 350 may be placed just before but proximate to the secondary filtering section 320.

Figure 7:
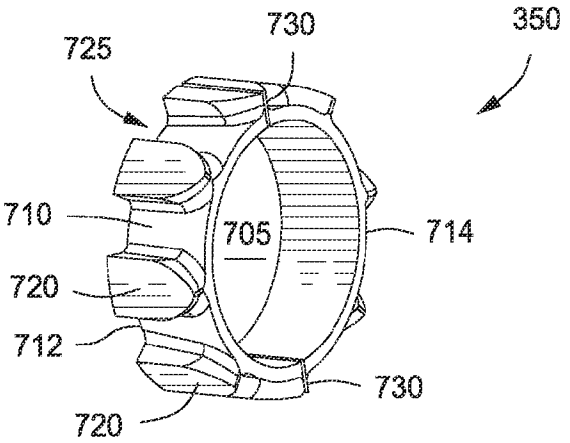
FIG. 7 is an enlarged perspective view of the baffle ring of FIG. 4B. A plurality of radial channels are seen between baffles formed around the baffle ring.

In the view of FIG. 4B, the under-flow ring 315 is exploded away from the filtering conduit 320*f*. The baffle ring 350 is seen intermediate the under-flow ring 315 and the filtering conduit 320*f*. FIG. 7 provides an enlarged perspective view of the baffle ring 350 of FIG. 4B alone. The illustrative baffle ring 350 defines a short tubular body 710, forming a bore 705 therethrough. No fluids flow through the bore 705.

The baffle ring 350 has a first end 712 and a second end 714. The baffle ring 350 is preferably formed by joining two semi-spherical pieces together. In FIG. 7, two seams 730 are seen running from the first end 712 to the second end 714. The seams 730 enable the baffle ring 350 to be placed over a section of non-perforated pipe as an extension to the perforated base pipe 335*p* as two pieces during fabrication. The seams 730 are then welded together and the baffle ring 350 is welded onto the outside of the selected pipe to form an annular seal.

The baffle ring 350 includes a plurality of outer ridges, or baffles 720. The baffles 720 are placed radially and equi-distantly around an outer diameter of the baffle ring 350. The baffles 720 disrupt the linear flow of the formation fluids as they exit the second end 614 of the under-flow ring 315.

Between the baffles 720 are a plurality of flow-through channels 725. The flow-through channels 725 direct the flow of formation fluids more evenly toward an outer diameter of the filtering medium 320*f* of the secondary filtering section 320.

Returning back to FIG. 4B, the exploded perspective view of the secondary section 320 also includes a welding ring 307. The welding ring 307 is a circular body that is welded to the first end 322 of the filter medium of the second filtering conduit 320*f* and the tubular body 330 to seal the first end 322 of the second filtering conduit 320*f*. The welding ring 307 prevents fluids in the annulus 328 from reaching fluid ports 331 on the base pipe 335*p* without first passing the filter medium of the second filtering conduit 320*f*. Optionally, the welding ring 307 may be replaced by or combined with a split-ring 305.

FIG. 4B shows the second end 324 of the filtering conduit 320*f* as being open. This allows fluid communication with a primary filtering section. Alternatively, the second end 324 may be sealingly attached to a connector such as a split-ring 305. The split-ring 305 may seal the annular region between the filter medium of the second filtering conduit 320*f* and the base pipe 335*p* at the second end 324 of the secondary section 320. The housing 340 welded onto the split-ring 305 seals the annular region 328.

The sand control devices 300A and 300B of FIGS. 3A and 3B, respectively, are beneficial in preventing the encroachment of sand into the bore of production tubing, such as tubing 130. The sand screens 300A, 300B may be installed as a standalone tool for downhole sand control. The sand screens 300A, 300B may alternatively be installed in an open hole and surrounded by a gravel pack. In gravel pack completions, the sand screen 300A or 300B is optionally equipped with shunt tubes. Illustrative shunt tubes for a well screen are described in U.S. Pat. Nos. 4,945,991, 5,113,935, and 5,515,915.

Figure 8A:
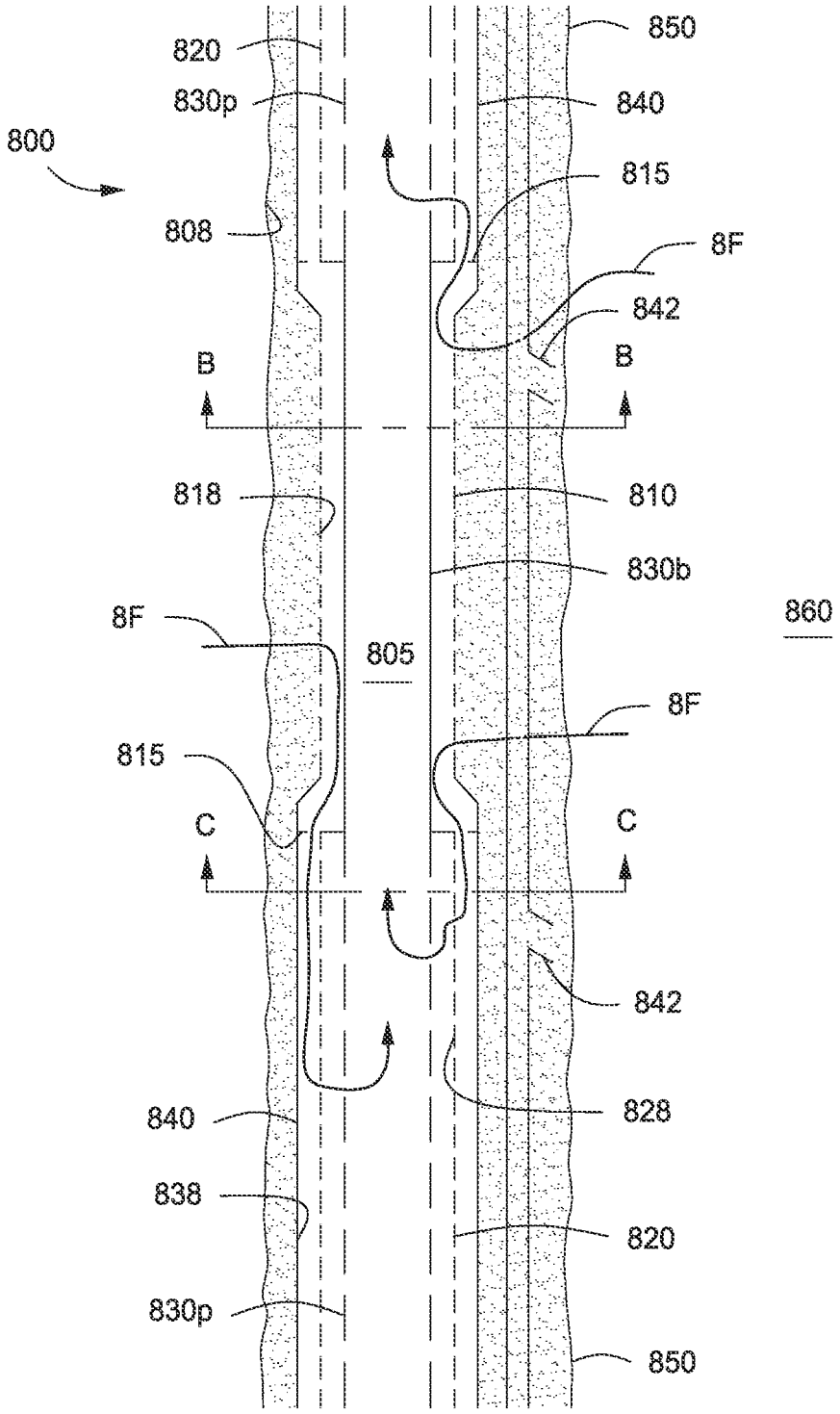
FIGS. 8A through 8C present a side view of a sand screen that may be used as part of a wellbore completion system having alternate flow channels. This screen utilizes primary and secondary permeable sections for filtering fluids downhole.

In order to better understand the flow control function of the sand screens 300A, 300B, a cross-sectional view is beneficial. FIG. 8A provides a side, cross-sectional view of a portion of a sand screen 800, in one embodiment. The sand screen 800 is disposed along an open hole portion of a wellbore 850. The wellbore 850 traverses a subsurface formation 860, with an annulus 808 being formed between the sand screen 800 and the surrounding formation 860.

It can be seen in FIG. 8A that the sand screen 800 has undergone gravel packing. The annulus 808 is shown in spackles, indicating the presence of gravel. The gravel pack provides support for the wellbore 800 along the formation 860 and assists in filtering formation particles during production. Further, the sand screen 800 itself serves to filter formation particles as fluids are produced from the formation 860.

The illustrative screen 800 utilizes concentric conduits to enable the flow of hydrocarbons while further filtering out formation fines. In the arrangement of FIG. 8A, the first conduit is a base pipe (represented by 830*p* and 830*b*); the second conduit is a first filtering conduit 810; the third conduit is a second filtering conduit 820; and a fourth conduit is an outer housing 840.

The base pipe 830 defines an inner bore 805 that receives formation fluids such as hydrocarbon liquids. As shown in FIG. 8A, the base pipe 830 offers alternating permeable and impermeable sections. The permeable sections are shown at 830*p*, while the impermeable sections are shown at 830*b*. The permeable sections 830*p* allow formation fluids to enter the bore 805, while the impermeable sections 830*b* divert formation fluids to the permeable sections 830*p*.

The first filtering conduit 810 is circumferentially disposed about the base pipe 830. More specifically, the first filtering conduit 810 is concentrically arranged around the impermeable section 830*b* of the base pipe.

The second filtering conduit 820 is adjacent to the first filtering conduit 810, and is also circumferentially disposed about the base pipe. More specifically, the second filtering conduit 810 is concentrically arranged around the permeable section 830*p* of the base pipe. In addition, the outer housing 840 is sealingly placed around the second filtering conduit 820.

The filtering conduits 810, 820 contain a filtering medium. The filtering media are designed to retain particles larger than a predetermined size, while allowing fluids to pass through. The filtering media are preferably wire-wrapped screens wherein gaps between two adjacent wires are sized to restrict formation particles larger than a predetermined size from entering the bore 805.

Figure 8B:
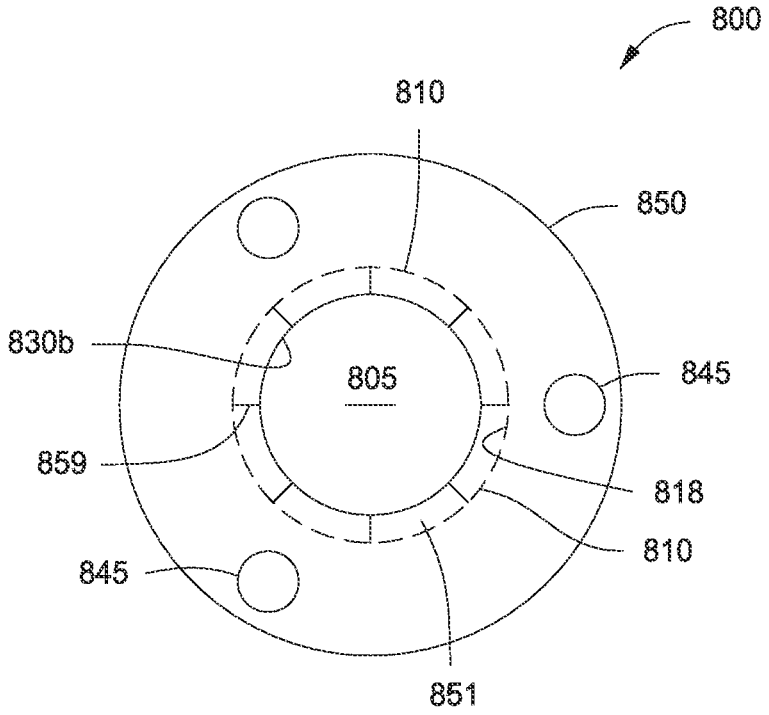
Figure 8C:
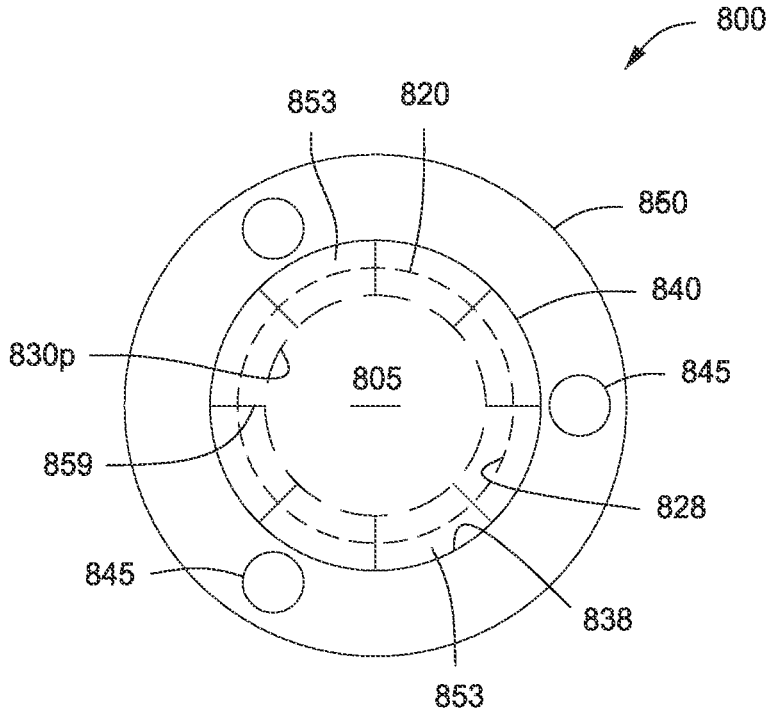

Cross-sectional views of the sand screen 800 are provided in FIGS. 8B and 8C. FIG. 8B is a cross-sectional view taken across line B-B of FIG. 8A, while FIG. 8C is a cross-sectional view taken across line C-C of FIG. 8A. Line B-B is cut across the impermeable or blank section 830*b* of the base pipe, while line C-C is cut across the permeable or slotted section 830*p* of the base pipe.

In FIG. 8B, a first annular region 818 is seen between the base pipe 830*b* and the surrounding first filtering conduit 810. Similarly, in FIG. 8C a second annular region 828 is seen between the base pipe 830*p* and the surrounding second filtering conduit 820. In addition, a third annular region 838 is seen between the second filtering conduit 820 and the surrounding outer housing 840.

Referring back to FIG. 8A, an under-flow ring 815 is placed between the first filtering conduit 810 and the second filtering conduit 820. The under-flow ring 815 directs formation fluids from the first annular region 818 to the third annular region 838. An inner diameter of the outer housing 840 wraps around an outer diameter of the under-flow ring 815 to provide a seal.

It can also be seen in the cross-sectional views of FIGS. 8B and 8C that a series of small tubes are disposed radially around the sand screen 800. These are shunt tubes 845. The shunt tubes 845 connect with alternate flow channels (not shown) to carry gravel slurry along a portion of the wellbore 850 undergoing a gravel packing operation. Nozzles 842 serve as outlets for gravel slurry so as to bypass any sand bridges (not shown) or packer (such as packers 212, 214 of FIG. 2) in the wellbore annulus 808.

The sand screen 800 of FIGS. 8A, 8B and 8C provides a staggered arrangement of filtering media. This causes fluids produced from the formation 860 to be twice filtered. It further provides an engineering redundancy in the event a portion of a filtering medium breaks open. Lines 8F demonstrate the movement of formation fluids into the bore 805 of the base pipe 830*p*.

It can also be seen in the cross-sectional views of FIGS. 8B and 8C that a series of optional walls 859 is provided. The walls 859 are substantially impermeable and serve to create chambers 851, 853 within the conduits 810, 820. Each of the chambers 851, 853 has at least one inlet and at least one outlet. Chambers 851 reside around the first conduit 810, while chambers 853 reside around the second conduit 820. Chambers 851 and 853 are fluidly connected. With or without the walls 859, the chambers 851, 853 are bound by split-rings 305, conduits 810, 820, base pipe 830*b*, under-flow ring 315, and the housing 840. The chambers 851, 853 are adapted to accumulate particles to progressively increase resistance to fluid flow through the chambers 851, 853 in the event a permeable section of a conduit is compromised or impaired and permits formation particles larger than a predetermined size to invade.

When a section of filter medium of the first filtering conduit is breached, sand will enter the annular region 818, continue travelling to the annular region 838, and be retained on the second conduit 820. As the sand accumulates in annular region 838 and starts to fill the chambers 853, the flow resistance in the subject chamber 853 around the second conduit 820 increases. Stated another way, frictional pressure loss in the sand-filled compartment increases, resulting in gradually diminished fluid/sand flow through the first conduit 810 along a compromised chamber 853. Fluid production is then substantially diverted to the first conduits 810 along other compartments. The sand screen 800 provides engineering redundancy for a sand control device. Thus, rather than producing sand through a damaged section of screen, the instant invention will tend to block off that section of screen by accumulating debris therein. Thus, the screen of the instant invention can be said to be self-healing to the extent that it tends to block flow through damaged screen sections.

In connection with the sand screen 800 generally, and with the sand screens 300A and 300B of FIGS. 3A and 3B, it is desirable to reduce the potential for so-called hot spots. The present inventions offer various techniques for reducing the velocity of production fluids as they travel from the first annular region 318 to the secondary filtering conduit 320*f*.

As noted, the use of dual primary filtering sections 310' as shown in FIG. 3B is effective in this effort. However, additional measures may also be taken.

Figure 9B:
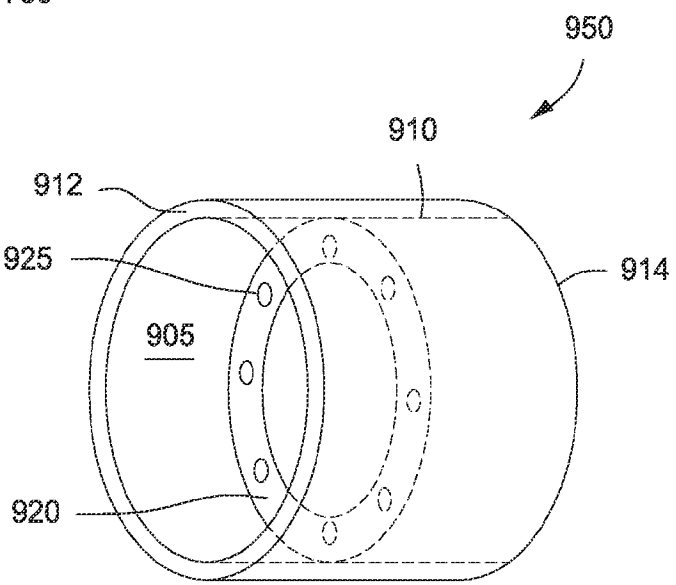
FIGS. 9A and 9B are perspective views of an in-flow control device as may be used in the sand screen of FIGS. 3A and 3B. A plurality of fluid distribution ports are seen along the circumference of the in-flow control device.
Figure 9A:
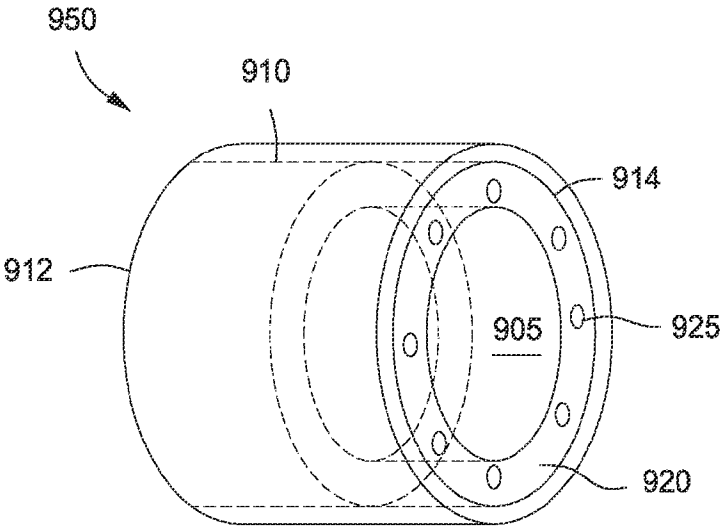

First, an in-flow control device may be provided along the third annular region 328 proximate to the under-flow ring 315. FIGS. 9A and 9B provide perspective views of an in-flow control device 950 as may be used in the sand screen 300B. The in-flow control device 950 is essentially a short tubular body 910. The body 910 has a first end 912 and a second end 914. The perspective view of FIG. 9A presents the second end 914, while the perspective view of FIG. 9B presents the first end 912.

In the arrangement of FIGS. 9A and 9B, the in-flow control device 950 includes an inner shoulder 920 similar to 520 in FIG. 5A. Placed radially and equi-distantly around the shoulder 920 is a plurality of fluid distribution ports 925. The fluid distribution ports 925 receive formation fluids from the second end 614 of the under-flow ring 315, and deliver the fluids into the annular region 328 around the second filtering conduit 320*f*.

The in-flow control device 950 is one example. In an alternate arrangement, the in-flow control device 950 can simply be a plate having radial openings.

It is noted that the secondary section 320 need not employ a definite baffling ring 350. Instead, fluid dispersion may take place by using an extended length of blank pipe, such as tubular body 330. In this instance, the outer housing 340 extends over the tubular body 330 before connecting to the under-flow ring 315. For instance, 2 feet (0.61 meters) to 5 feet (1.52 meters) of pipe may be spaced between the under-flow ring 315 and the second filtering conduit 320*f*.

Figure 10A:
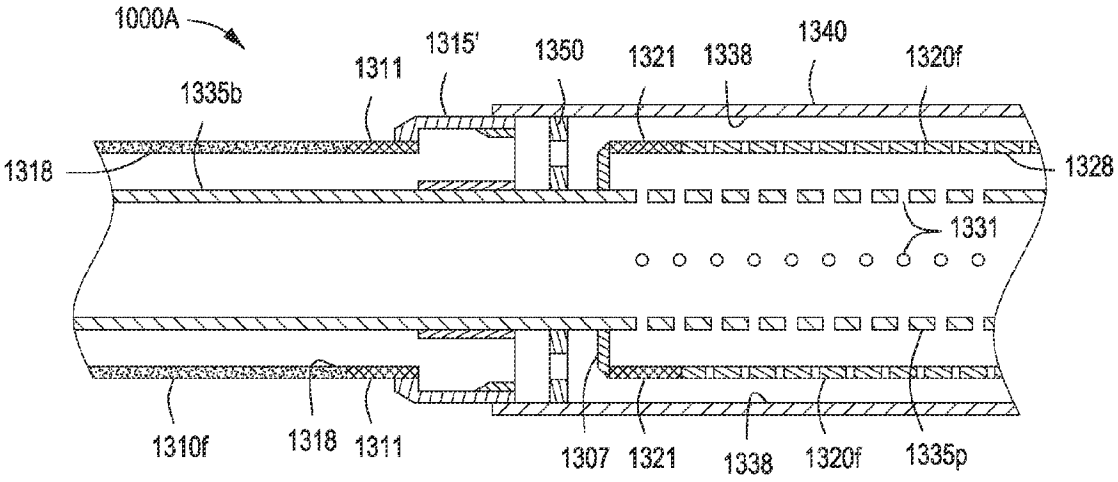
FIG. 10A is a cross-sectional view of a portion of the sand screen, or sand control device, of FIG. 3B, in one embodiment. Here, portions of the sand control device are fabricated from a ceramic material to inhibit sand erosion. The in-flow control ring shown as an under-flow ring.

First, FIG. 10A presents a cross-sectional view of a portion of the sand control device of FIG. 3B, in one embodiment. Here, the sand control device is designated with reference number 1000A. While the sand control device is intended to represent a portion of the sand control device of FIG. 3B, it is understood that it might also represent the sand control device of FIG. 3A.

The sand control device 1000A includes a both a first filtering conduit 1310*f* and a second filtering conduit 1320*f*. The first filtering conduit 1310*f* corresponds to conduit 310*f* of FIG. 3B, while the second filtering conduit 1320*f* corresponds to conduit 320*f* of FIG. 3B. Thus, the first filtering conduit 1310*f* is depicted as a wire mesh, while the second filtering conduit 1320*f* is depicted as a wire-wrapped screen or an optional ceramic screen.

The sand control device 1000A includes a base pipe 1335 that extends through both the first filtering conduit 1310*f* and the second filtering conduit 1320*f*. The base pipe 1335 includes an impermeable section 1335*b* and a permeable section 1335*p*. The permeable section 1335*p* has a plurality of perforations 1331.

The sand control device 1000A also include a housing 1340 around the second filtering conduit 1320*f*. Additionally, an in-flow control ring 1315' is offered which provides fluid communication between a first annular region 1318 (formed between the base pipe 1335*b* and the surrounding first filtering conduit 1310*f*) and a third annular region 1338 (formed between the second filtering conduit 1320*f* and the surrounding housing 1340). The illustrative in-flow control ring 1315' is an under-flow ring.

In FIG. 10A, an optional baffle ring 1350 is provided adjacent the under-flow ring 1315'. Baffle ring 1350 corresponds to baffle ring 350 of FIG. 7. A seal ring 1307 (corresponding to seal ring 307 from FIG. 3B) is also shown.

To minimize erosion, portions of the sand control device 1000A are fabricated from a ceramic material or, optionally, a hardened steel material. These portions are shown at 1311 and 1321. Ceramic portion 1311 is provided at an end of the first filtering conduit 1310*f* adjacent the under-flow ring 1315', while ceramic portion 1321 is provided at an end of the second filtering conduit 1320*f* around the seal ring 1307. These are considered to be areas of vulnerability for the sand screen 300B.

In addition to or as an alternative to the use of a ceramic material along the sand control device, it is desirable to reduce the velocity of production fluids as they move from the first annular region 1318 (the area between the impermeable section of the base pipe and the surrounding first filtering conduit) to the third annular region 1338 (the area between the second filtering conduit and the surrounding housing). This may be done in any of a number of ways, as discussed below.

Figure 10B:
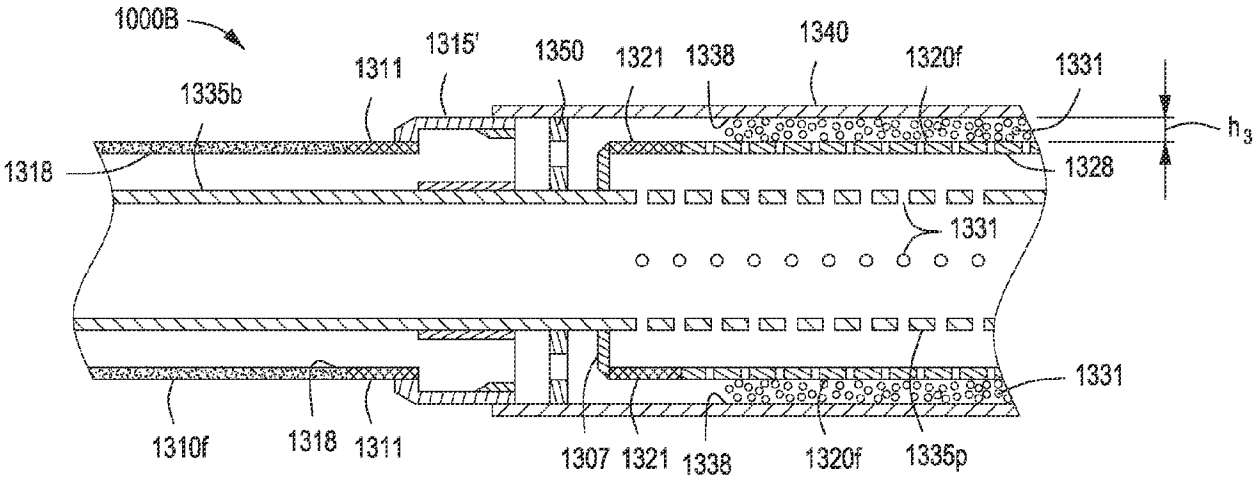
FIG. 10B is another cross-sectional view of the sand screen of FIG. 10A. Here, portions of the sand control device are fabricated from an optional ceramic material to inhibit sand erosion. The sand control device is also configured to reduce the fluid velocity peaks between the first annular region and the second annular region by adding a highly porous medium along a portion of the third annular region.

FIG. 10B is another cross-sectional view of the sand screen of FIG. 10A, denoted at 1000B. Here, the sand control device is configured to reduce the velocity of fluid flow between the first annular region 1318 and the third annular region 1338 by adding a highly porous medium 1331 along at least a portion of the third annular region 1338. The porous medium may be, for example, a large-grained sand, rubber pellets, ceramic chips, steel shot, foam, shape memory polymer, sintered metal, fibers, or other porous material.

The area of the third annular region 1338 may be adjusted as well. In FIG. 10B, the gap between the second filtering conduit 1320*f* and the surrounding housing 1340 is indicated by "$h_3$." Increasing the gap $h_3$ will reduce the radial fluid flow velocity into the second filtering conduit 1320*f* near 1321. Reducing the gap $h_3$ will reduce the radial fluid flow velocity into the second filtering conduit 1320*f* on the side opposite to 1321.

Figure 11A:
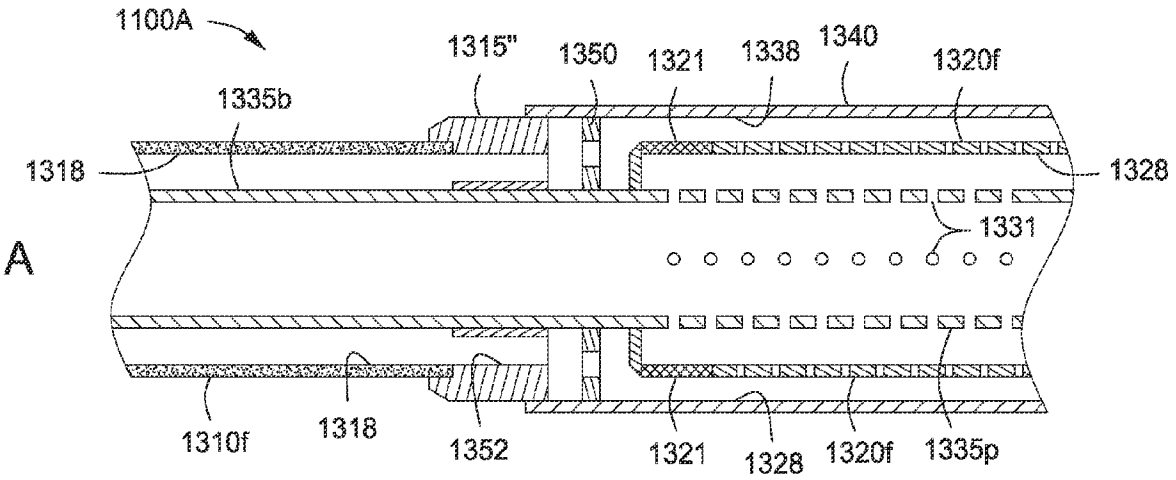
FIG. 11A is a cross-sectional view of the portion of the sand screen, or sand control device, of FIG. 3A or 3B, in one embodiment. Here, the sand control device is configured to control fluid flow from the first annular region into the third annular region by using an in-flow control device as the in-flow control ring.

FIG. 11A is another cross-sectional view of the portion of the sand control device 300B of FIG. 3B, in an alternate embodiment. Here, the sand control device is designated with reference number 1100A. As with sand control device 1000 of FIG. 10, sand control device 1100A includes a both a first filtering conduit 1310*f* and a second filtering conduit 1320*f*. The first filtering conduit 1310*f* corresponds to conduit 310*f* of FIG. 3B, while the second filtering conduit 1320*f* corresponds to conduit 320*f* of FIG. 3B. Thus, the first filtering conduit 1310*f* is depicted as a wire mesh, while the second filtering conduit 1320*f* is depicted as a wire-wrapped screen.

In order to regulate the flow of fluid between the first annular region and the third annular region, an in-flow control device 1315" is used as the in-flow control ring. The in-flow control device 1315" uses two or more small through-openings 1352 that create a pressure drop in the sand control device 1100A. The in-flow control device 1315" may be configured in accordance with in-flow control device 950 of FIGS. 9A and 9B. More preferably, the diameter of the through-openings 1352 is adjustable, such as through the delivery of a wired or wireless signal to the device 1100A before or during production.

Figure 11B:
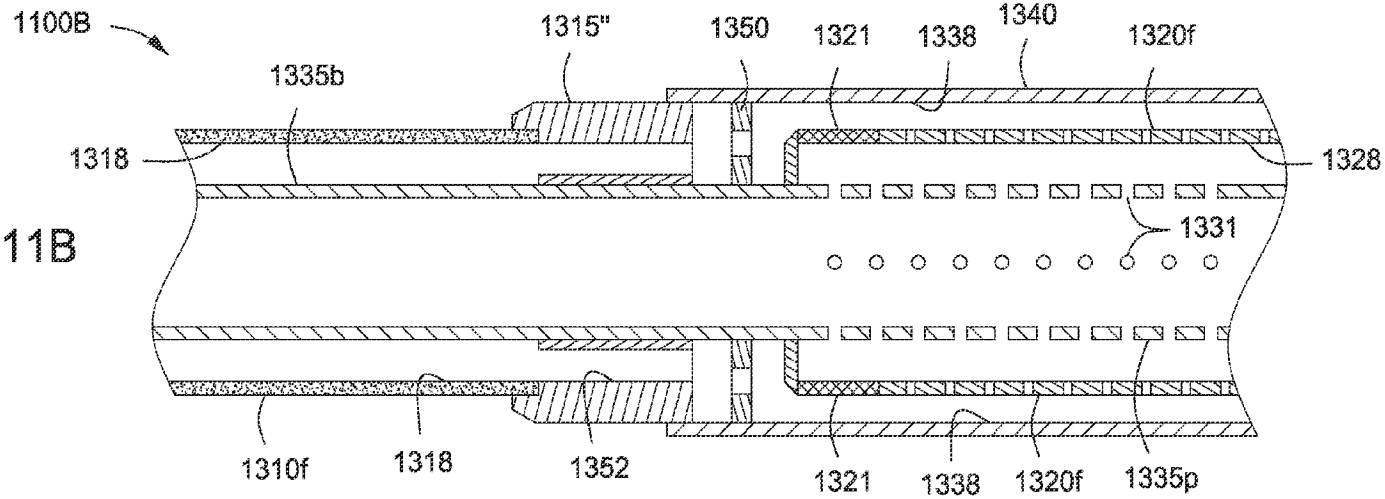
FIG. 11B is another cross-sectional view of the portion of the sand control device of FIG. 3A or 3B, in an alternate embodiment. Here, the sand control device is configured to reduce the velocity of fluid flow between the first annular region and the third annular region by extending the length of the under-flow ring.

FIG. 11B is another cross-sectional view of the portion of the sand control device 300B of FIG. 3B, in an alternate embodiment. Here, the sand control device is designated with reference number 1100B. Sand control device 1100B is generally configured in accordance with sand control device 1100A. In order to redistribute the flow of fluid to be more uniform as fluid travels from the first annular region 1318 to the third annular region 1338, the device 1100B uses an in in-flow control device 1315" or the under-flow ring 1315' having an extended length. Preferably, the under-flow ring 1315' has a length that is greater than six inches (15.24 cm). More uniform fluid flow means a reduced maximum or peak velocity.

Figure 11C:
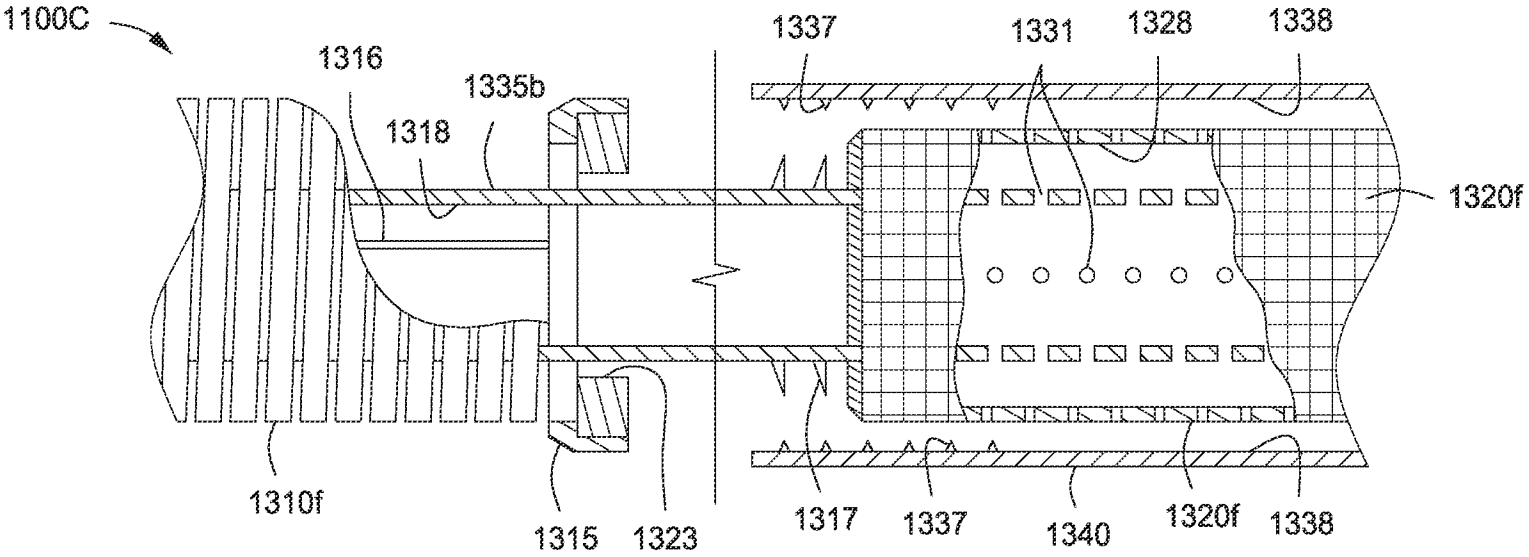
FIG. 11C is a cut-away view of a portion of the sand control device of FIG. 3A, in an alternate embodiment. Here, the sand control device is configured to reduce the velocity of fluid flow between the first annular region and the third annular region by extending the length of the base pipe between the under-flow ring and the second filtering conduit.

FIG. 11C offers another option for reducing fluid flow velocity. FIG. 11C is a cut-away view of a portion of the sand control device 300A of FIG. 3A, in one embodiment. Here, the sand control device is designated with reference number 1100C. The sand control device 1100C includes a both a first filtering conduit 1310*f* and a second filtering conduit 1320*f*. The first filtering conduit 1310*f* corresponds to conduit 310*f* of FIG. 3A, while the second filtering conduit 1320*f* corresponds to conduit 320*f* of FIG. 3B. Thus, the first filtering conduit 1310*f* is depicted as a wire mesh, while the second filtering conduit 1320*f* is depicted as a wire-wrapped screen.

The sand control device 1100C includes a base pipe 1335 that extends through both the first filtering conduit 1310*f* and the second filtering conduit 1320*f*. The base pipe 1335 includes an impermeable section 1335*b* and a permeable section 1335*p*. The impermeable section 1335*p* has a plurality of perforations 1331.

In order to streamline the fluid flow between the first annular region and the third annular region, the sand control device 1100C extends the length of the impermeable section 1335*b* of the base pipe between the under-flow ring 1315 and the second filtering conduit 1320*f*. Preferably, the impermeable section 1335*b* has at least two feet of length between the under-flow ring 1315 and the second filtering conduit 1320*f*. In addition, at least a portion of the impermeable section 1335*b* includes helical grooves 1317 to cause mixing and friction loss of production fluids during production. In addition, a grooved or ribbed profile 1337 may be provided along an inner wall of the outer housing 1340. In addition, the under-flow ring 1315' may be modified to itself be an in-flow control device by substantially reducing an inner diameter 1323.

Additional ways for streamlining the velocity of fluid flow may be offered. Some of these relate to the configuration of the sand control device within the second filtering conduit. These are demonstrated in connection with FIGS. 12A and 12B.

Figure 12A:
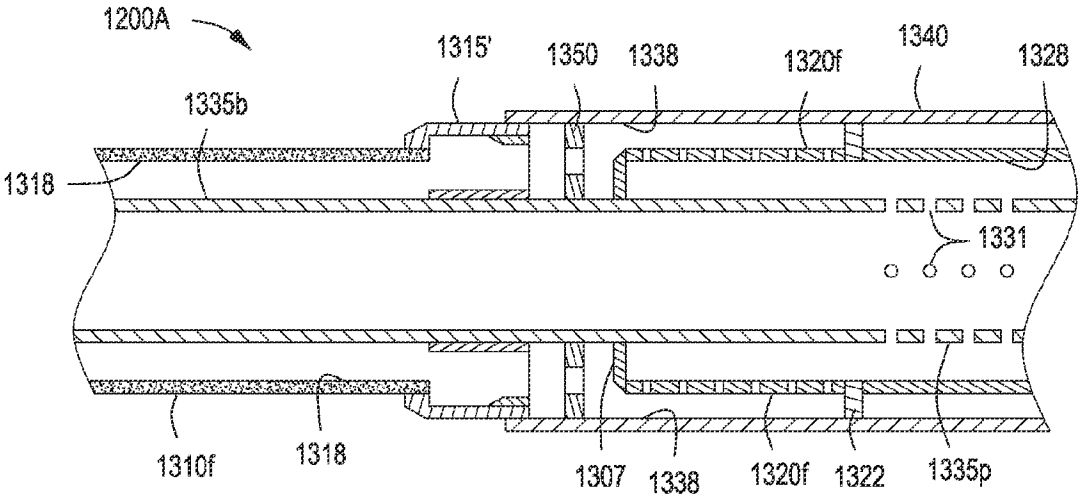
FIG. 12A is another cross-sectional view of a portion of the sand control device of FIG. 3B, in an alternate embodiment. Here, the sand control device is configured to redistribute fluid flow more evenly and thereby reduce maximum fluid velocity into a secondary screen along the third annular region by extending the length of the impermeable section of the base pipe past the beginning of the second filtering conduit.
Figure 12B:
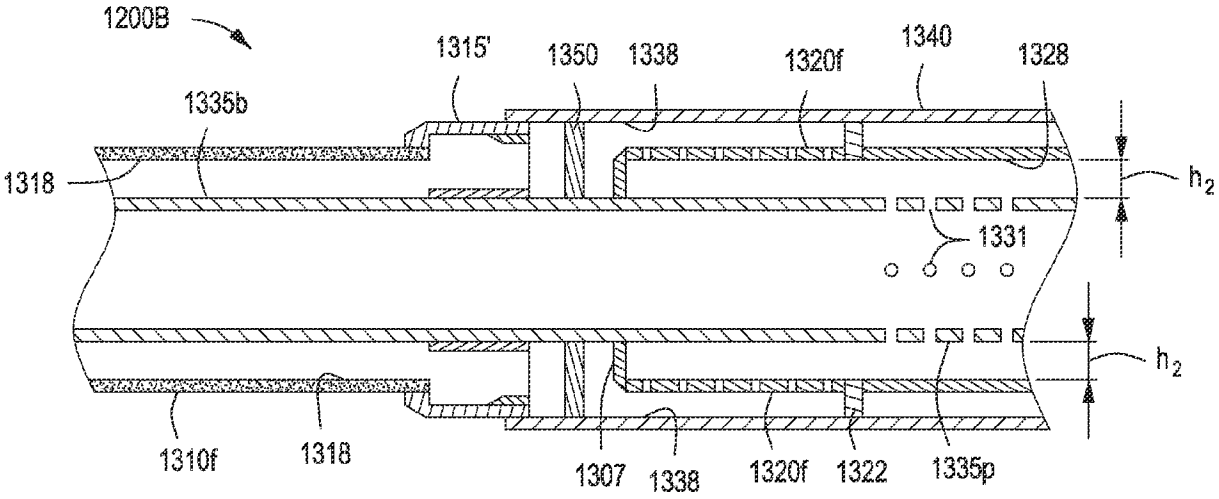
FIG. 12B is another cross-sectional view of the sand control device of FIG. 12A, in an alternate embodiment. Here, the sand control device is configured to redistribute fluid flow more evenly and thereby reduce maximum fluid velocity into a secondary screen along the third annular region by increasing the radial clearance of the second annular region.

FIGS. 12A through 12B offer additional cross-sectional views of the portion of the sand control device 300B of FIG. 3B, in alternate embodiments. In these drawings, the sand control devices are designated with reference numbers 1200A, 1200B, 1200C and 1200D, respectively. As with sand control device 1000 of FIG. 10, sand control devices 1200A through 1200D each include a first filtering conduit 1310*f* as well as a second filtering conduit 1320*f*. The first filtering conduit 1310*f* corresponds to conduit 310*f* of FIG. 3B, while the second filtering conduit 1320*f* corresponds to conduit 320*f* of FIG. 3B.

Each of sand control devices 1200A and 1200B is configured to extend the length of the impermeable section of the base pipe 1335*b* beyond the beginning of the second filtering conduit 1320*f*. This means that fluids are forced through the filtering conduit 1320*f* and into the second annular region 1328, and then flow along a section of blank pipe within the second annular region 1328 before reaching the perforations 1131 in the permeable section 1335*p* of the base pipe. This is aided by the placement of an annular disc 1322 within the third annular region 1338.

In addition, in FIG. 12B, the radial clearance of the second annular region 1328 is increased. Preferably, this is done by providing a distance "$h_2$" of at least 0.25 inches (0.64 cm) between the outer diameter of the impermeable section of the base pipe 1335*b* and an inner diameter of the second filtering conduit 1320*f*.

Figure 12C:
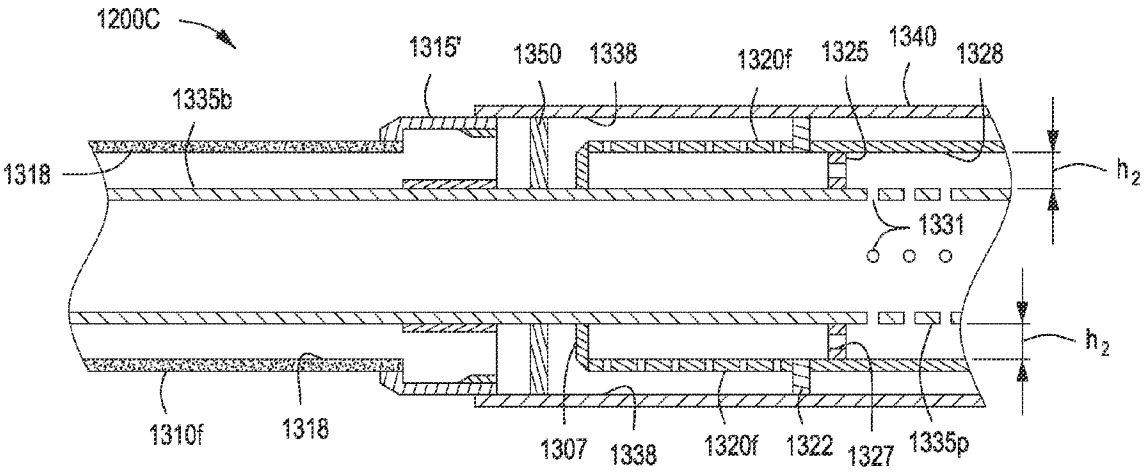
FIG. 12C is another cross-sectional view of the sand control device of FIG. 12A, in an alternate embodiment Here, the sand control device is configured to redistribute fluid flow more evenly and thereby reduce maximum fluid velocity into a secondary screen along the third annular region by extending the length of the impermeable section of the base pipe past the beginning of the second filtering conduit. In addition, an in-flow control device is disposed within the second annular region.

FIG. 12C is another cross-sectional view of the sand control device of FIG. 12A, in an alternate embodiment. Here, the sand control device, designated as 1200C, is configured to reduce the maximum velocity of fluid flow between the first annular region 1318 and the third annular region 1338 by extending the length of the impermeable section of the base pipe 1335*b* past the beginning of the second filtering conduit 1320*f*. In addition, an in-flow control device 1325 is disposed within the second annular region 1328. The in-flow control device 1325 has a "tuned" through-opening 1327 that regulates fluid flow from the second annular region 1328 through the perforations 1331.

Placement of the in-flow control device 1325 within the second annular region 1328 allows an operator to temporarily seal off the sand control device 1200C during a remedial operation. In this respect, the operator may inject a viscous gel or thick sand slurry down the bore 1335 of the well. A portion of that gel or slurry will flow through the base pipe perforations 1331 and move behind the perforated base pipe 1335*p*. Beneficially, the gel or slurry will generally plug at the through-opening 1327 of the in-flow control device 1325. In this way, a so-called "pill" can be employed.

It is noted that a pill may be employed using the sand control device 1200C even without the in-flow control device 1325. In some instances, the operator may prefer not to have the in-flow control device 1325 present to allow slurry to more freely fill the second annular region 1328 without plugging the in-flow control device 1325. In this instance, the sand screen would preferably utilize an in-flow control device as the in-flow control ring. This is shown in FIG. 12D.

Figure 12D:
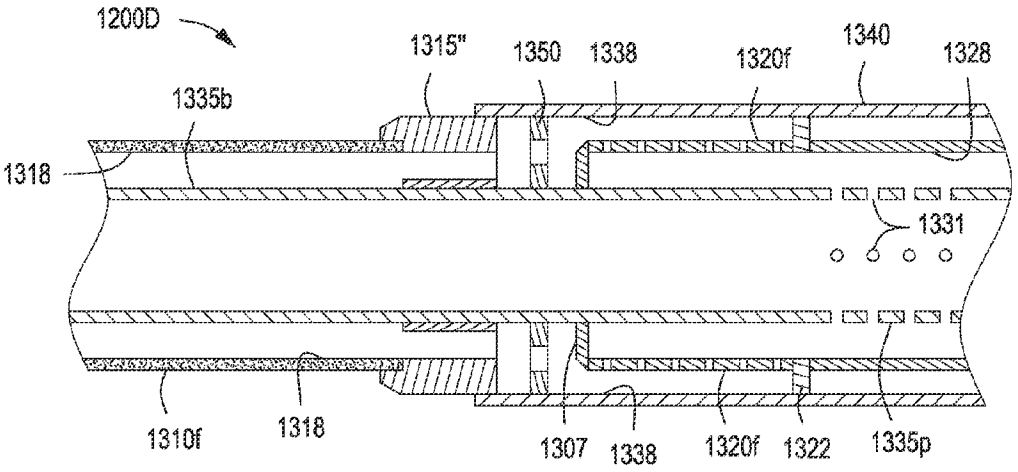
FIG. 12D is another cross-sectional view of the sand control device of FIG. 12A, in an alternate embodiment. Here, the sand control device is configured to regulate fluid flow from the first annular region into the third annular region by utilizing an in-flow control device as the in-flow control ring.

FIG. 12D is another cross-sectional view of the sand control device of FIG. 12A, in an alternate embodiment. Here, the sand control device is denoted as 1200D. The sand control device 1200D utilizes an in-flow control device 1315" as the in-flow control ring. In addition, the length of the impermeable section of the base pipe 1335*b* is extended past the beginning of the second filtering conduit 1320*f*.

As can be seen, various sand screen arrangements are offered for protecting hardware components from "hot spots" by streamlining the fluid flow or reducing the maximum or peak velocity. Utilizing these sand screens, a method for completing a wellbore in a subsurface formation is provided herein. In one embodiment, the method first includes providing a sand control device. The sand control device is designed in accordance with the sand control devices described above, in their various embodiments. The sand control device may have one, two, three, or more compartments.

The method also includes running the sand control device into a wellbore. The sand control device is lowered to a selected subsurface location. The sand control device thereby forms an annulus in the wellbore between the sand control device and the surrounding wellbore.

The sand control device may be run into a new wellbore as a stand-alone screen. Alternatively, the sand control device may be placed in the wellbore along with a gravel pack. In this latter arrangement, the method further includes injecting a gravel slurry into the wellbore. The gravel slurry is injected in order to form a gravel pack in the annulus between the sand control device and the surrounding formation.

The base pipe is in fluid communication with a string of production tubing. The flow channels of the under-flow ring are oriented to direct the flow of production fluids from the first annular region into the third annular region, then through the second annular region and into the base pipe, and then up to surface via the production tubing during a production operation.

In any instance, the base pipe of the sand control device is in fluid communication with a string of production tubing.

The sand control device may be run into a new wellbore as a stand-alone screen. Alternatively, the sand control device may be placed in the wellbore along with a gravel pack.

In one aspect, the sand control device comprises at least one shunt tube external to the first filtering conduit and the second filtering conduit. The at least one shunt tube runs longitudinally substantially along the first compartment and the second compartment, and provides an alternate flow channel for gravel slurry during the gravel-packing operation. In this instance, the method further comprises injecting the gravel slurry at least partially through the at least one shunt tube to allow the gravel slurry to bypass any premature sand bridges or any packers around the sand control device so that the wellbore is more uniformly gravel-packed within the annulus.

In an alternative arrangement of the method, the sand control device is run into an existing wellbore. In this instance, the sand control device is placed within the inner diameter of an existing completion tool. Such a completion tool may be, for example, a perforated pipe or a previous sand screen.

In one embodiment of the method, the formation fluids comprise hydrocarbon fluids. The method then further comprises producing hydrocarbon fluids from the subsurface formation. Producing hydrocarbon fluids from the subsurface formation means producing hydrocarbons through the filtering medium of the first filtering conduit, along the first annular region, through the under-flow ring, into the third annular region, through the filtering media of the second filtering conduit, into the permeable section of the base pipe, and up the production tubing.

The above-described inventions offered an improved sand control device, and an improved method for completing a wellbore using an improved sand screen. The sand control device may be claimed as follows:

While it will be apparent that the inventions herein described are well calculated to achieve the benefits and advantages set forth above, it will be appreciated that the inventions are susceptible to modification, variation and change without departing from the spirit thereof. An improved sand control device is provided for restricting the flow of particles from a subsurface formation into a tubular body within a wellbore.

What is claimed is:

1. A sand control device for restricting the flow of particles into a wellbore, the sand control device comprising:

at least a first compartment, wherein each compartment comprises:

a base pipe having an impermeable section and a permeable section, and a bore therein for receiving production fluids through the permeable section;

a first filtering conduit circumscribing the base pipe and forming a first annular region between the base pipe and the first filtering conduit, the first filtering conduit having a filtering medium adjacent the impermeable section of the base pipe;

a second filtering conduit also circumscribing the base pipe and forming a second annular region between the base pipe and the second filtering conduit, the second filtering conduit having a filtering medium adjacent the permeable section of the base pipe;

a blank tubular housing circumscribing the second filtering conduit and forming a third annular region between the second filtering conduit and the surrounding housing;

an in-flow control ring disposed along the base pipe between the first filtering conduit and the second filtering conduit, the in-flow control ring placing the first annular region in fluid communication with the third annular region;

an in-flow control device within the second annular region and disposed before the permeable section of the base pipe; and wherein the at least first compartment is configured to reduce flow velocity as production fluids travel from the in-flow control ring to the third annular region;

wherein the second filtering conduit is configured to filter particulates from entering the permeable section of the basepipe in event of a breach of the first filtering conduit by the particulates, whereby in such breach event the third annular region fills with the particulates to further restrict fluid and particulate flow to the second filtering conduit; and wherein the impermeable section of the base pipe extends past a beginning of the second filtering conduit to the permeable section of the base pipe, and the velocity of fluids flowing from the in-flow control ring to the third annular region is reduced along the impermeable section of the base pipe within the second annular region before reaching the permeable section.

2. The sand control device of claim 1, wherein the in-flow control ring comprises an under-flow ring that reduces the velocity of fluid flowing from the first annular region to the third annular region.

3. The sand control device of claim 2, further comprising:

an in-flow control device adjacent the under-flow ring and having one or more flow channels that creates a pressure drop in addition to that of the under-flow ring.

4. The sand control device of claim 1, wherein the in-flow control ring is an under-flow ring and the under-flow ring has an outer diameter that sealingly receives the blank tubular housing at an end.

5. The sand control device of claim 4, wherein the under-flow ring further comprises:

at least two inner ridges circumferentially spaced about the inner diameter; and flow channels between the at least two inner ridges for directing formation fluids from the first annular region into the second annular region during a production operation.

6. The sand control device of claim 1, further comprising:

a baffle ring disposed between the in-flow control ring and the second filtering conduit for circumferentially dispersing fluids as the fluids move from the first annular region to the third annular region; and wherein the baffle ring comprises a tubular body having an inner diameter and an outer diameter.

7. The sand control device of claim 6, wherein:

the baffle ring has an outer diameter that sealingly receives the blank tubular housing at an end.

8. The sand control device of claim 6, wherein:

the baffle ring has an outer diameter that is adjacent to an outer diameter of the in-flow control ring.

9. The sand control device of claim 1, wherein:

the in-flow control ring is an in-flow control device having one or more flow channels that creates a pressure drop; and the rate of fluids flowing from the first annular region to the third annular region is controlled by the placement of the in-flow control device.

10. The sand control device of claim 1, wherein:

the impermeable section of the base pipe extends from the in-flow control ring to the second filtering conduit and the velocity of fluids flowing from the first annular region to the third annular region is reduced along the impermeable section of the base pipe.

11. The sand control device of claim 1, wherein:

a cross-sectional flow area of the third annular region is reduced with respect to the cross-sectional flow area of the in-flow control ring to reduce the velocity of fluids flowing from the in-flow control ring to the third annular region.

12. The sand control device of claim 1, further comprising a porous medium in at least a portion of the third annular region to reduce the velocity of fluids flowing from the in-flow control ring to the third annular region.

13. The sand control device of claim 12, further comprising:

a section of blank pipe is disposed between the in-flow control ring and the second filtering conduit for permitting a circumferential dispersion of fluids as the fluids move from the first annular region to the third annular region;

wherein:

the housing also circumscribes the section of blank pipe; and an inner diameter of the surrounding housing comprises helical grooves or ribs for mixing production fluids.

14. The sand control device of claim 1, wherein:

the in-flow control ring comprises an in-flow control device.

15. The sand control device of claim 14, wherein the in-flow control device is fabricated from a ceramic material.

16. The sand control device of claim 1, wherein:

the filtering medium of the first filtering conduit and the filtering medium of the second filtering conduit each comprises a wound wire screen or a wire mesh; and the first filtering conduit and the second filtering conduit are each substantially concentrically placed around the base pipe.

17. The sand control device of claim 1, wherein:

the sand control device is normally between about 10 feet (3.05 meters) and 45 feet (13.71 meters) in length.

18. The sand control device of claim 1, wherein:

the first filtering conduit comprises a first end and a second end;

the first annular region in the first compartment is sealed at the first end;

an in-flow control ring is placed along the first filtering conduit at the second end;

the second filtering conduit comprises a first end proximal to the first filtering conduit, and a second end distal to the first filtering conduit;

the second and third annular regions in the first compartment are sealed at the second end of the second filtering conduit; and the blank tubular housing circumscribes the second filtering conduit and is also sealed at the second end of the second filtering conduit.

19. The sand control device of claim 1, wherein:

the second filtering conduit comprises a first end and a second opposite end;

the first filtering conduit and the in-flow control ring are disposed adjacent to first end of the second filtering conduit; and the at least one compartment further comprises:

a third filtering conduit circumscribing the base pipe and forming a fourth annular region between the base pipe and the third filtering conduit, the third filtering conduit having a filtering medium adjacent an impermeable section of the base pipe at the second end of the second filtering conduit, and an in-flow control ring disposed along the base pipe between the third filtering conduit and the second filtering conduit, placing the fourth annular region in fluid communication with the third annular region; and wherein the at least a first compartment is also configured to reduce flow velocity as production fluids travel from the fourth annular region to the second annular region.

20. A method for completing a wellbore in a subsurface formation, the method comprising:

providing a sand control device, the sand control device comprising:

at least a first compartment, wherein each compartment comprises:

a base pipe having a permeable section and an impermeable section, the base pipe being in fluid communication with a string of production tubing within the wellbore by means of a bore, a first filtering conduit circumscribing the base pipe and forming a first annular region between the base pipe and the first filtering conduit, the first filtering conduit having a filtering medium adjacent the impermeable section of the base pipe, a second filtering conduit also circumscribing the base pipe and forming a second annular region between the base pipe and the second filtering conduit, the second filtering conduit having a filtering medium adjacent the permeable section of the base pipe, a blank tubular housing circumscribing at least the second filtering conduit and forming a third annular region between the second filtering conduit and the surrounding housing, and an in-flow control ring disposed along the base pipe between the first filtering conduit and the second filtering conduit and placing the first annular region in fluid communication with the third annular region, and the in-flow control ring having an outer diameter that receives the blank tubular housing at an end;

an in-flow control device within the second annular region and disposed before the permeable section of the base pipe; and wherein the at least first compartment is configured to reduce flow velocity as production fluid travels from the in-flow control ring to the third annular region;

wherein the impermeable section of the base pipe extends past a beginning of the second filtering conduit to the permeable section of the base pipe, and the velocity of fluids flowing from the in-flow control ring to the third annular region is reduced along the impermeable section of the base pipe within the second annular region before reaching the permeable section; and wherein the second filtering conduit is configured to filter particulates from entering the permeable section of the basepipe in event of a breach of the first filtering conduit by the particulates, whereby in such breach event the third annular region fills with the particulates to further restrict fluid and particulate flow to the second filtering conduit; and running the sand control device into a wellbore to a selected subsurface location, and thereby forming an annulus in the wellbore between the sand control device and the surrounding wellbore.

21. The method of claim 20, further comprising:

running the at least a first compartment into an inner diameter of a completion tool of a previously-completed wellbore.

22. The method of claim 21, wherein the completion tool is a perforated pipe or a sand control device.

23. The method of claim 20, further comprising:

injecting a gravel slurry into the wellbore in order to form a gravel pack around the sand control device and within the annulus.

24. The method of claim 20, wherein the filtering medium of the first filtering conduit and the filtering medium of the second filtering conduit each comprises a wound wire screen or a wire mesh.

25. The method of claim 24, wherein the at least a first compartment comprises at least a first compartment and a second compartment.

26. The method of claim 24, wherein the first filtering conduit and the second filtering conduit are each substantially concentrically placed around the base pipe.

27. The method of claim 24, further comprising:

at least a second compartment adjacent the first compartment.

28. The method of claim 24, further comprising:

a section of blank pipe is disposed between the in-flow control ring and the second filtering conduit for permitting a circumferential dispersion of fluids as the fluids move from the first annular region to the third annular region; and wherein:

the housing also circumscribes the section of blank pipe, and an inner diameter of the section of blank pipe comprises helical grooves or ribs for mixing production fluids.

29. The method of claim 20, wherein:

the in-flow control ring is an under-flow ring and the rate of fluids flowing from the in-flow control ring to the third annular region is at least partially controlled by the under-flow ring.

30. The method of claim 29, wherein the at least a first compartment further comprises:

an in-flow control device, the in-flow control device including an orifice that creates a pressure drop, wherein the velocity of fluid flowing from the first annular region to at least one of the second annular region and the third annular region is reduced by the in-flow control device.

31. The method of claim 20, wherein:

reducing the velocity of fluids flowing from the first annular region to the third annular region along the impermeable section of the base pipe.

32. The method of claim 20, wherein:

decreasing a cross-sectional flow area of the third annular region with respect to the cross-sectional flow area of the in-flow control ring to reduce the velocity of fluids flowing from the in-flow control ring to the third annular region.

33. The method of claim 20, wherein:

(i) the in-flow control ring comprises an in-flow control device.

34. The method of claim 20, wherein:

the in-flow control ring is an under-flow ring;

the under-flow ring has an outer diameter that sealingly receives the blank tubular housing at an end; and the at least a first compartment further comprises:

a baffle ring disposed between the under-flow ring and the second filtering conduit for circumferentially dispersing fluids as the fluids move from the first annular region to the third annular region, wherein the baffle ring comprises:

a tubular body having an inner diameter and an outer diameter, at least two inner ridges radially spaced about the inner diameter, and flow channels between the at least two inner ridges for directing formation fluids from the first annular region into the second annular region during a production operation.

35. The method of claim 20 wherein:

the sand control device is normally between about 10 feet (3.05 meters) and 45 feet (12.71 meters) in length.

36. The method of claim 35, wherein:

the first filtering conduit comprises a first end and a second end;

the first annular region in the first compartment is sealed at the first end;

an in-flow control ring is placed along the first filtering conduit at the second end;

the second filtering conduit comprises a first end proximal to the first filtering conduit, and a second end distal to the first filtering conduit;

the second and third annular regions in the first compartment are sealed at the second end of the second filtering conduit; and the blank tubular housing circumscribes the second filtering conduit and is also sealed at the second end of the second filtering conduit.

37. The method of claim 35, wherein:

the second filtering conduit comprises a first end and a second opposite end;

the first filtering conduit and a first in-flow control ring are disposed at a first end of the second filtering conduit; and the at least one compartment further comprises:

a third filtering conduit circumscribing the base pipe and forming a fourth annular region between the base pipe and the third filtering conduit, the third filtering conduit having a filtering medium adjacent an impermeable section of the base pipe at the second end of the second filtering conduit, and an in-flow control ring disposed along the base pipe between the third filtering conduit and the second filtering conduit, placing the fourth annular region in fluid communication with the third annular region; and wherein the at least a first compartment is also configured to reduce flow velocity as production fluids travel from the fourth annular region to the second annular region.

38. The method of claim 20, further comprising:

producing hydrocarbon fluids from the subsurface formation, through the filtering medium of the first filtering conduit, along the first annular region, through the under-flow ring, into the third annular region, through the filtering media of the second filtering conduit, into the second annular region, through the permeable section of the base pipe, and up the production tubing.

39. The method of claim 20, further comprising:

placing a pill within at least one of the second annular region and third annular region.

* * * * *